US005824231A

United States Patent [19]

Blomberg

[11] Patent Number: 5,824,231

[45] Date of Patent: Oct. 20, 1998

[54] METHOD AND A DEVICE FOR SEPARATION AND COLLECTION OF SUBSTANCES FLOATING IN WATER

[75] Inventor: Erling Blomberg, Göteborg, Sweden

[73] Assignee: Erling Blomberg AB, Västra Frölunda, Sweden

[21] Appl. No.: 652,434

[22] PCT Filed: Nov. 30, 1994

[86] PCT No.: PCT/SE94/01148

§ 371 Date: Jul. 12, 1996

§ 102(e) Date: Jul. 12, 1996

[87] PCT Pub. No.: WO95/15417

PCT Pub. Date: Jun. 8, 1995

[30] Foreign Application Priority Data

| | | | |
|---|---|---|---|
| Nov. 30, 1993 | [SE] | Sweden | 9303985 |
| Jan. 2, 1994 | [SE] | Sweden | 9400003 |
| Jan. 9, 1994 | [SE] | Sweden | 9400031 |
| Jan. 21, 1994 | [SE] | Sweden | 9400172 |
| Feb. 8, 1994 | [SE] | Sweden | 9400409 |
| Nov. 15, 1994 | [SE] | Sweden | 9403930 |

[51] Int. Cl.[6] ..... E02B 15/04

[52] U.S. Cl. ..... 210/776; 210/788; 210/242.3; 210/512.1; 210/923

[58] Field of Search ..... 210/776, 292.3, 210/923, 540, 512.1, 787, 788

[56] References Cited

U.S. PATENT DOCUMENTS

| | | | |
|---|---|---|---|
| 3,722,689 | 3/1973 | Murkel et al. | 210/242.3 |
| 3,753,496 | 8/1973 | Boyd | 210/923 |
| 3,753,497 | 8/1973 | Hoffman | 210/923 |
| 3,983,034 | 9/1976 | Wilson | 210/923 |
| 4,139,470 | 2/1979 | Stagemeyer et al. | 210/242.3 |
| 4,510,054 | 4/1985 | Wylie | 210/242.3 |
| 4,514,299 | 4/1985 | Ayroldi | 210/242.3 |
| 5,200,066 | 4/1993 | Jorgensen | 210/512.1 |

FOREIGN PATENT DOCUMENTS

| | | |
|---|---|---|
| 0017168 | 10/1980 | European Pat. Off. . |
| 0129279 | 12/1984 | European Pat. Off. . |
| 142951 | 8/1980 | Norway . |
| 169643 | 4/1992 | Norway . |
| 616190 | 3/1980 | Switzerland . |

*Primary Examiner*—Christopher Upton
*Attorney, Agent, or Firm*—Jeffrey Slusher

[57] ABSTRACT

The invention concerns a method and a device for separation and collection of substances floating in water by making use of a relative motion between the water containing the substances and a collection container having trapping means associated therewith. In accordance with the invention the water motion relatively to a collection container is made use of to create a circulating movement therein. The circulating movement is obtained by bringing the water to enter the collection container essentially tangentially with respect to the latter. The removal of the substances in question is effected in the circulating water flow. Cleaned water is evacuated along the collection container bottom.

14 Claims, 23 Drawing Sheets

9
15
10
24
28
13
12a
23
25
22
12
1
11
17
III
III

27

METHOD AND A DEVICE FOR SEPARATION AND COLLECTION OF SUBSTANCES FLOATING IN WATER

BACKGROUND OF THE INVENTION

1. Field of the Invention

The subject invention concerns a method of separating and collecting substances, primarily oil, floating in water, by making use of a relative motion between the water containing the substances and a collection container having trapping means associated therewith.

The invention also concerns a device for performing the method.

2. Description of the Related Art

It is previously known to use oil-boom types of collection devices which are suspended across a watercourse to collect oil or other substances floating in water, and the oil boom arranged to guide the substances to a collection container from which the substances are removed directly or indirectly for deposition or destruction. In accordance with the prior-art technology the oil boom may be suspended across a watercourse or be stretched between two vessels moving at low speed in open waters. However, these trapping devices are useful only when the water moves at a very low speed, in general below 0.5 knots, above all because the substances in question, primarily oil, tends to be entrained in the water passing below the oil boom. In addition it is very difficult to effeciently remove the collected substances from the collection container or from a bight in the oil boom which often forms a dammed-up area in which the substances find themselves in stagnant water.

The primary object of the subject invention is to provide a method and a device for making the collection more efficient and to facilitate removal of the substances from the water for further transportation.

SUMMARY OF THE INVENTION

The method in accordance with the invention is essentially characterized in that the collection container is placed in the water with a peripheral opening that intersects the water surface being turned obliquely towards the flow direction of the water in relation to the collection container in such a manner that water containing said substances flows essentially tangentially into to the collection container to create inside the collection container a rotating water motion, removing the substances in question from the collection container in the created water vortex while on account of the downwardly directed pressure created by the vortex remaining water is evacuated from the collection container, in the following referred to as "circulation chamber", at the bottom thereof. In this manner the speed of the water flowing towards the collection container and carrying the substances in question, is made use of in order to create, inside the collection container, a whirling or vortical motion. Efficient collection in the collection container interior is thus achieved as well as efficient removal of the oil and other substances by means of suitably positioned removal devices, for instance of so called skimmer type. Such removal devices could be placed in a stationary condition inside the collection container since the water automatically will move towards these devices, whereby the substances in question may be easily skimmed off the uppermost water layer. The vortical motion brings about a concentration of the substances, allowing local positioning of the removal devices, preferably close to the vortex centre.

In addition, this arrangement increases the possibility of efficiently clearing the water at great speed.

A device in accordance with the invention designed to solve the above problems and also exhibiting the advantages outlined above is characterized in that the collection container comprises, at its periphery, a vertically extending enveloping wall which intersects the water surface in the operative position of the device, a bottom joined to said wall at the base thereof, and inlet opening formed in said enveloping wall for admission of water laden with such substances and having an extension below as well as above the water surface, said trapping means comprising a trapping arm likewise intersecting the water surface and extending, from one lateral delimiting edge of the inlet opening, from the collection container almost tangentially with respect to the adjoining portion of the enveloping wall for the purpose of guiding the water and the substances essentially tangentially, i.e. in the circumferential direction of the collection container to create a vortex therein, i.e. a circulating water motion.

BRIEF DESCRIPTION OF THE DRAWINGS

In the following several embodiments of the invention will be described in closer detail with reference to the accompanying drawings, wherein.

DETAILED DESCRIPTION

Figure 1:
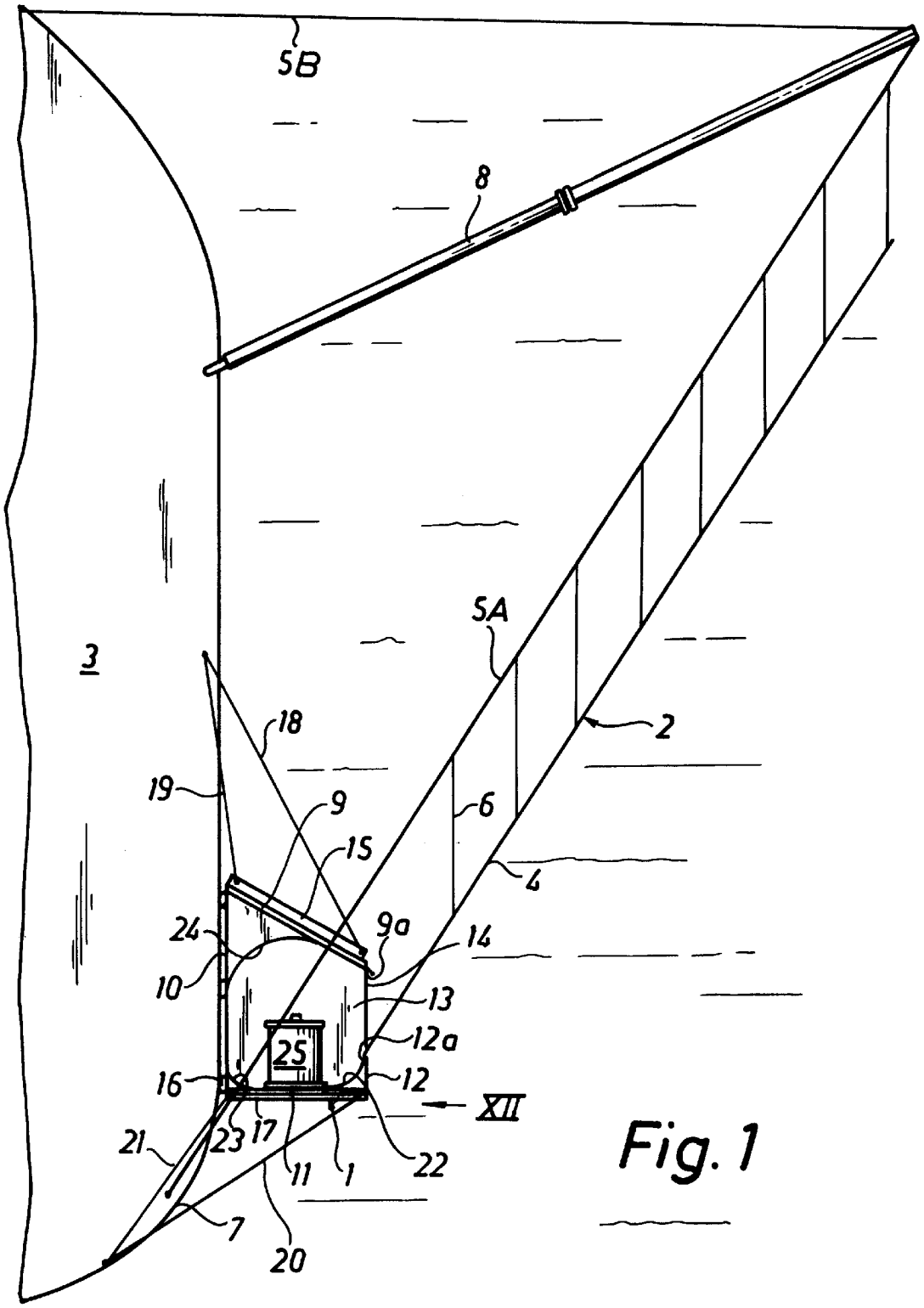
FIG. 1 is a schematical view from above showing a device in accordance with the first embodiment of the invention in position of use by the side of a vessel.
Figure 2:
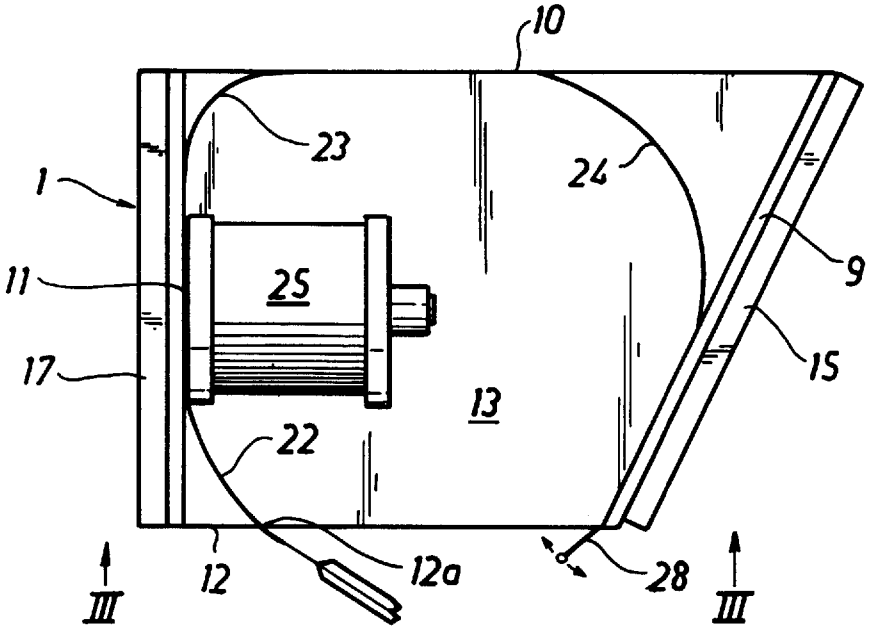
FIG. 2 is a corresponding view from above of a detail of FIG. 1.
Figure 3:
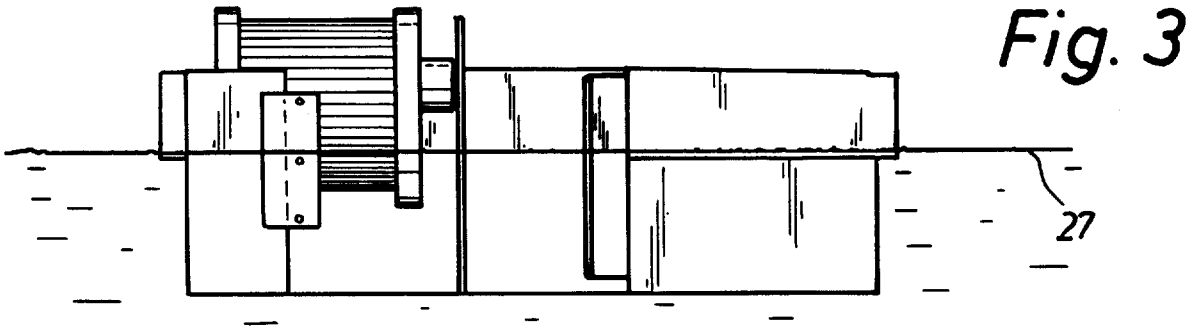
FIG. 3 is a lateral view as seen in the direction of arrows III of the detail illustrated in FIG. 2.
Figure 4:
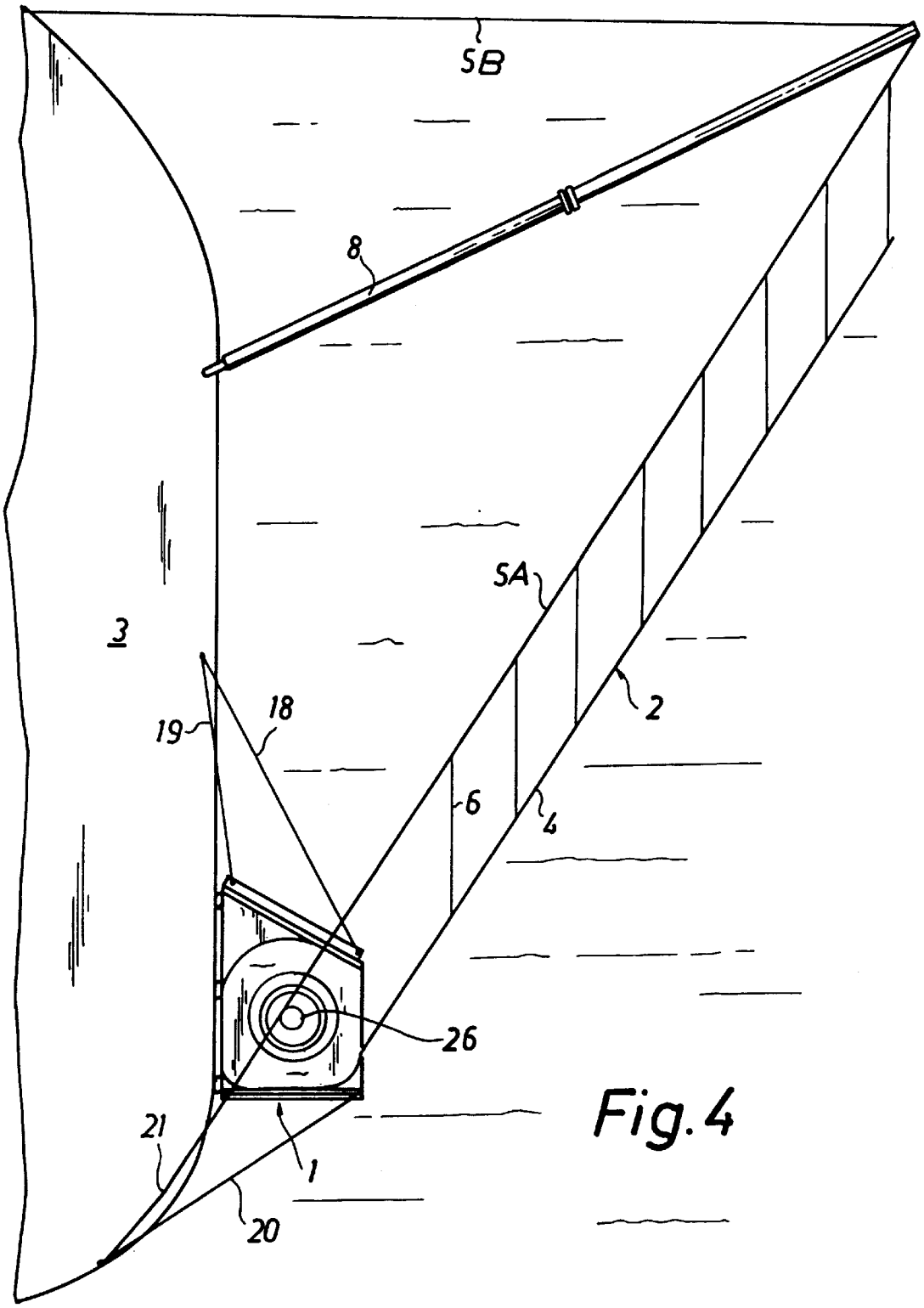
FIG. 4 is a view from above corresponding to FIG. 1, of the device having a different type of equipment for removal and transportation of collected oil.

In FIG. 1 numeral reference 1 is used to indicate a collection container generally for reception of the substances, primarily oil, floating in water. Numeral 2 designates generally a trapping device associated with the collection container 1. Numeral reference 3 is used to designate generally a vessel of which only one half is shown schematically, with which vessel the collection container 1 and the catching device 2 are associated in a manner to be disclosed in closer detail in the following. Detail components incorporated in the collection and trapping device according to FIG. 1 are shown in the subsequent drawing FIGS. 2–15. In accordance with the embodiment shown the catching device 2 consists of an oil boom which is constructed from an elongate foldable cloth 4 which is maintained in an unfolded taut condition horizontally and in a position at right angles to the drawing figure plane vertically by means of a relief line 5 and a number of support lines 6 extending in spaced apart positions between the relief line and the collection cloth. The relief line 5 extends from a point of attachment 7 astern on the vessel 3 up to the outer end part of the spacer boom 8 forming an outrigger arm projecting from the vessel side. The collection container 1 is formed with an oblique front wall 9 extending at an angle from the side of the vessel towards the aft, a lateral wall 10 extending alongside the vessel side, a transverse rear wall 11, an outer lateral wall 12 and a bottom 13 attached to the lower ends of said walls. Intermediate the aft end 9*a* of the front wall and the end 12*a* of the lateral wall 12 turned towards the fore, an inlet opening 14 is formed which is delimited at its bottom by the bottom 13. Numerals 15, 16 and 17 designate floats provided on respectively the front, lateral and rear walls of the collection container and positioned at a height ensuring that the collection container bottom 13 will be located below the water surface when the container is submerged into the water. The floats 16 preferably also are designed as fenders to prevent friction between the collection container and the vessel sides. The front, lateral and rear walls of the collection container constitute the collection container walls that intersect the water surface. Between the front wall and the vessel side two attachment lines 18 and 19 extend and between the rear wall 11 and the aft portion of the vessel two attachment lines 20 and 21 likewise extend. In the interior of the collection container arcuately curved inner wall members 22, 23 and 24 extend above the container corner portions and thus they form an arcuately curved inner wall surface inside the collection container. The cloth 4 of the oil boom is by means of one of its ends attached to the aft edge 12*a* of the inlet opening, such that the oil boom 2 forms a trapping arm extending obliquely outwards and towards the fore to guide water and the substances to be collected and separated inside the collection container into the latter via the inlet opening 14 as will be described in closer detail in the following. Numeral reference 25 designates a device serving to draw up oil etcetera collected inside the collection container and to transport it further. The removal device 25 in accordance with FIG. 1 is in the form of a so called drum skimmer. FIG. 4 corresponds to FIG. 1 with the difference that the drum skimmer 25 has been replaced by another type of removal device, in the latter case a so called screw skimmer 26 which is arranged in the central part of the collection container. For the sake of clarity the collection container 1 is shown separately on an enlarged scale in FIGS. 2 and 3. FIG. 3 illustrates the suitable draught of the collection container, i.e. its extension above and below the water surface 27. FIG. 3 likewise shows that the drum skimmer 25 extends somewhat below the water surface 27 for the purpose of removing substances floating thereon. The inlet opening may also be equipped with devices 28 to regulate the inlet size for the purpose of regulating the in-flow speed into the collection container.

Figure 5:
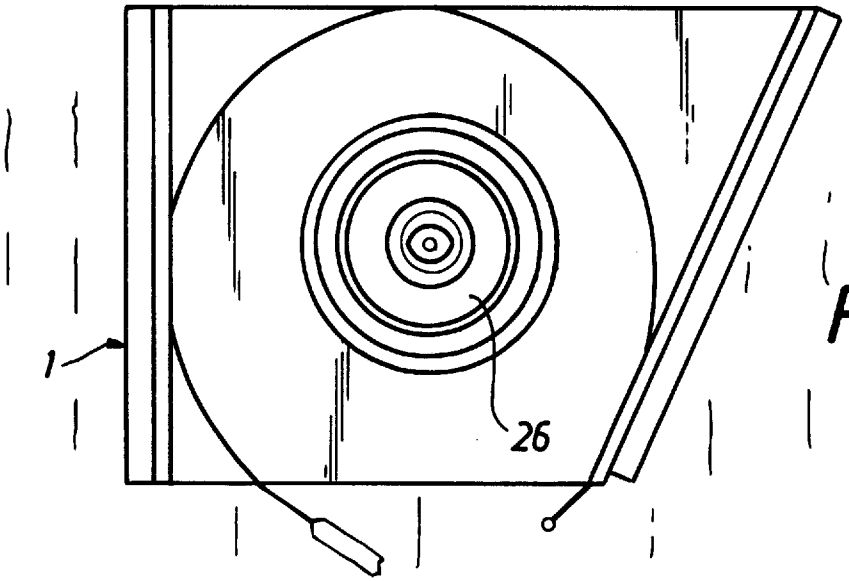
FIGS. 5 and 6 are views corresponding to those of FIGS. 2 and 3, of the collection container including the alternative equipment for removal and transportation of oil.
Figure 6:
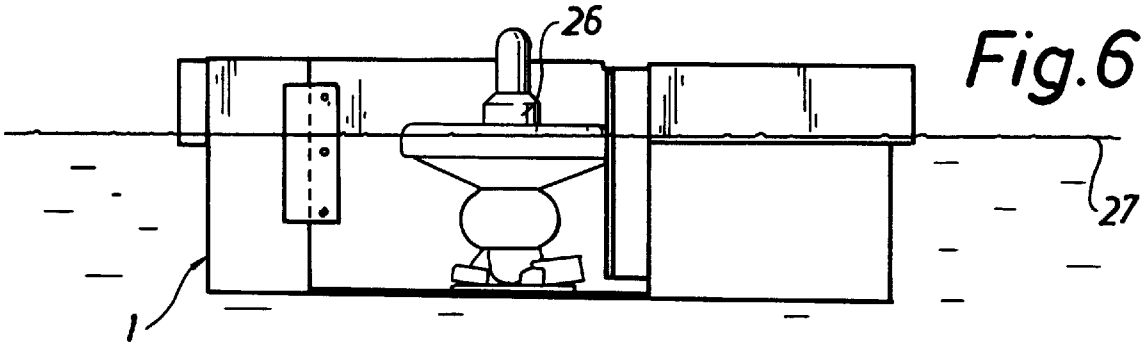

FIGS. 5 and 6 give a clearer picture of the positioning of the so called screw skimmer. As is most clearly apparent from FIG. 12 the draught of the oil boom cloth or the oil boom wall 4 is smaller than the draught of the collection container, i.e. the depth D below the water surface of the bottom 13. This relationship is a suitable one but it is within the scope of the invention to impart to the oil boom cloth 4 a different draught from that shown.

Figure 13:
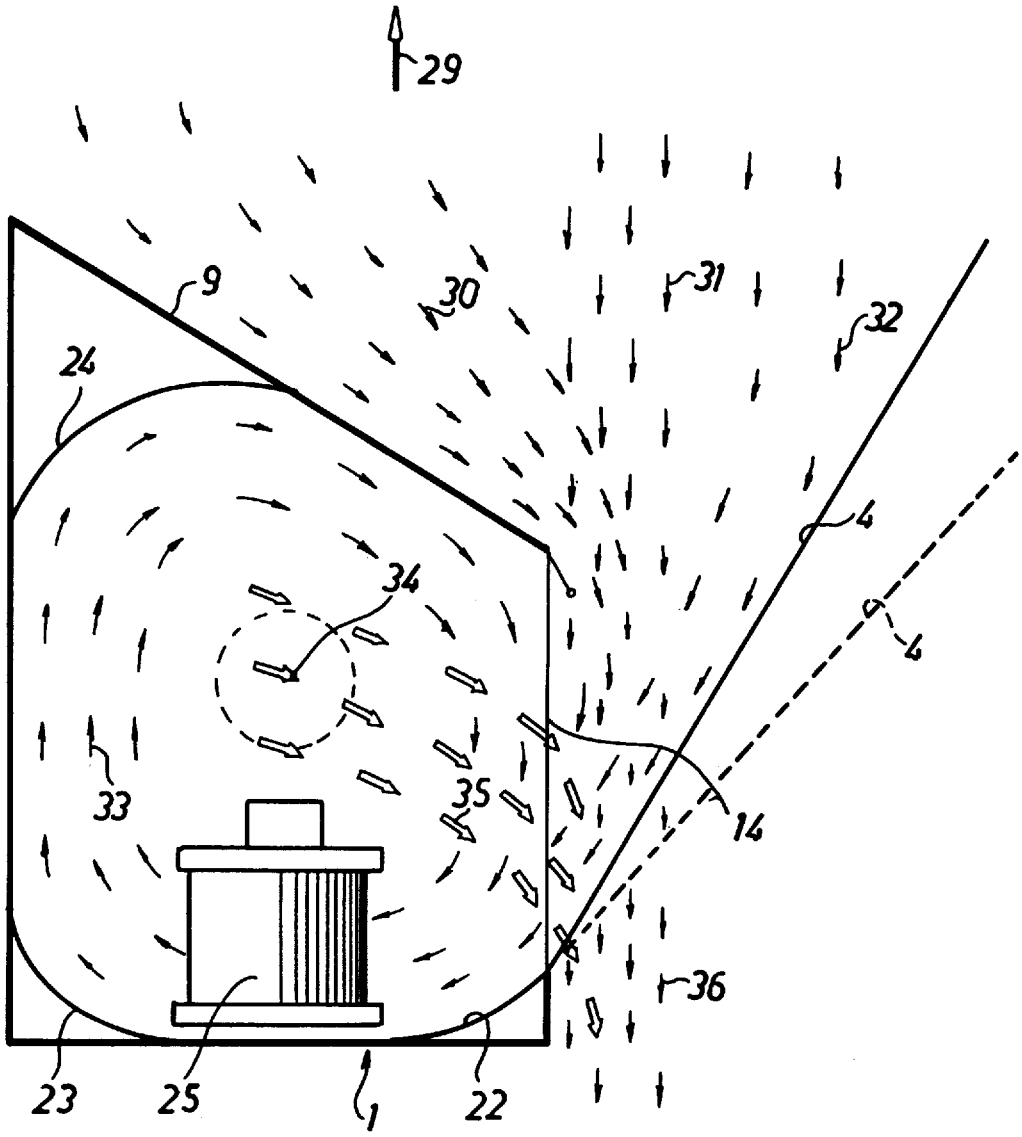
FIG. 13 is a view from above of the device in accordance with FIGS. 1–3 in which the directional flows are indicated.

When the vessel moves in the water in the direction indicated by arrow 29 in FIG. 13 water will flow with great force into the interior of the collection container 1 through the inlet opening 14 while being guided by the collection front wall 9 and by the oil boom wall 4 as indicated by flow arrows 30, 31 and 32, i.e. flow arrows 30 indicate the part of the flow of water guided by the front wall 9, arrows 31 indicate the mass of water moving essentially straight towards the inlet opening and arrows 32 indicate the mass of water that is guided by the oil boom wall 4. This means that the mass of water in the surface layer in the interior of the collection container will be given a rotating or circulating motion as indicated by flow arrows 33. The rotating motion generates a whirl or a vortex having its centre 34 in the central part of the collection container. Owing to the hydrodynamic pressure formed in the vortex, the flow of water is forced downwards and as indicated by flow arrows 35 again out through the opening 14, in this case at the lower part thereof. The lower water layers which unimpeded pass below the oil beam past the opening 14 as indicated by arrows 36, have an ejecting effect on the flow of water streaming out of the collection container and thus contribute to flow motion. The substances entering into the collection container thus are imparted a circulating movement in the direction towards the container centre. Owing to this motion, the substances pass through the removal device 25 the latter, although stationary, thus being able to efficiently remove the substances in question from the water which then, having been cleared, moves downwards owing to the hydrodynamical pressure and out of the collection container. Consequently there is no damming-up effect preventing new water from flowing into the collection container, in the following referred to as the rotary or circulation container. It is within the scope of the invention to leave out the arcuately curved inner wall members 22–24, the latter, however, contributing to the circulating motion. The motion and pressure of the in-flow water thus is made use of to create a circulating movement inside the collection container without any assistance from mechanical driving means. As also illustrated in FIG. 13 the angular position of the oil boom wall could be changed. When operating in streaming water the collection container could be anchored therein, preferably to a shore bank, and the oil boom 2 be placed in a stretched condition and obliquely towards the flow direction, in principle in the same manner as illustrated in the drawing figures just described. Because of the oblique position of the oil boom 4 with respect to the flow direction 31 of the water, the speed of the flow at right angles to the oil boom will be reduced to an extent corresponding to the obliqueness, which means that it becomes possible to operate in waters streaming at a high speed in relation to the collection container without risking that the substances to be removed escape below the catching device. The possibility of high flow velocities makes it easier to manoeuvre the vessel provided with the device in accordance with the invention, for instance in the case of oil removals, also when the weather conditions are not ideal. At a sweeping speeds exceeding for instance about 2 knots, the manoeuvering of the sweeping vessel is greatly facilitated, which also means that the removal capacity of the device and the area of the water surface being swept become comparatively large. The curved inner wall members 22–24 preferably consist of a PVC-cloth extended above the corners of the rotational unit but also rigid sheet metal plates or other corresponding arcuately curved members obviously would contribute to the creation of a laminar flow field.

The oil boom wall 4 guides, as mentioned above, as well water as substances floating on the water into the rotational unit, and water as well as oil and the like are forced to form a rotating water current inside the rotational unit under the lee of its front wall 9. The front wall creates a still-water area in the interior of the rotational unit.

The water entering the rotational unit from the oil boom creates an increase of the static pressure. The static pressure is transformed to a dynamic pressure in the almost stagnant water in the centre of the rotational unit and, as mentioned above, water is forced out through the open side of the rotational unit, while being moved along the bottom of the latter.

By increasing the draught of the rotational unit it becomes possible to increase the water-outflow area while allowing reduction of the length of the rotational unit. If the rotational unit is prolonged it becomes possible to reduce its draught. This is of importance when operating with the aid of the rotational unit in shallow water-courses and the like e.g. alongside river banks where therefore the use of deep-draught rotational units is prevented.

Figure 7:
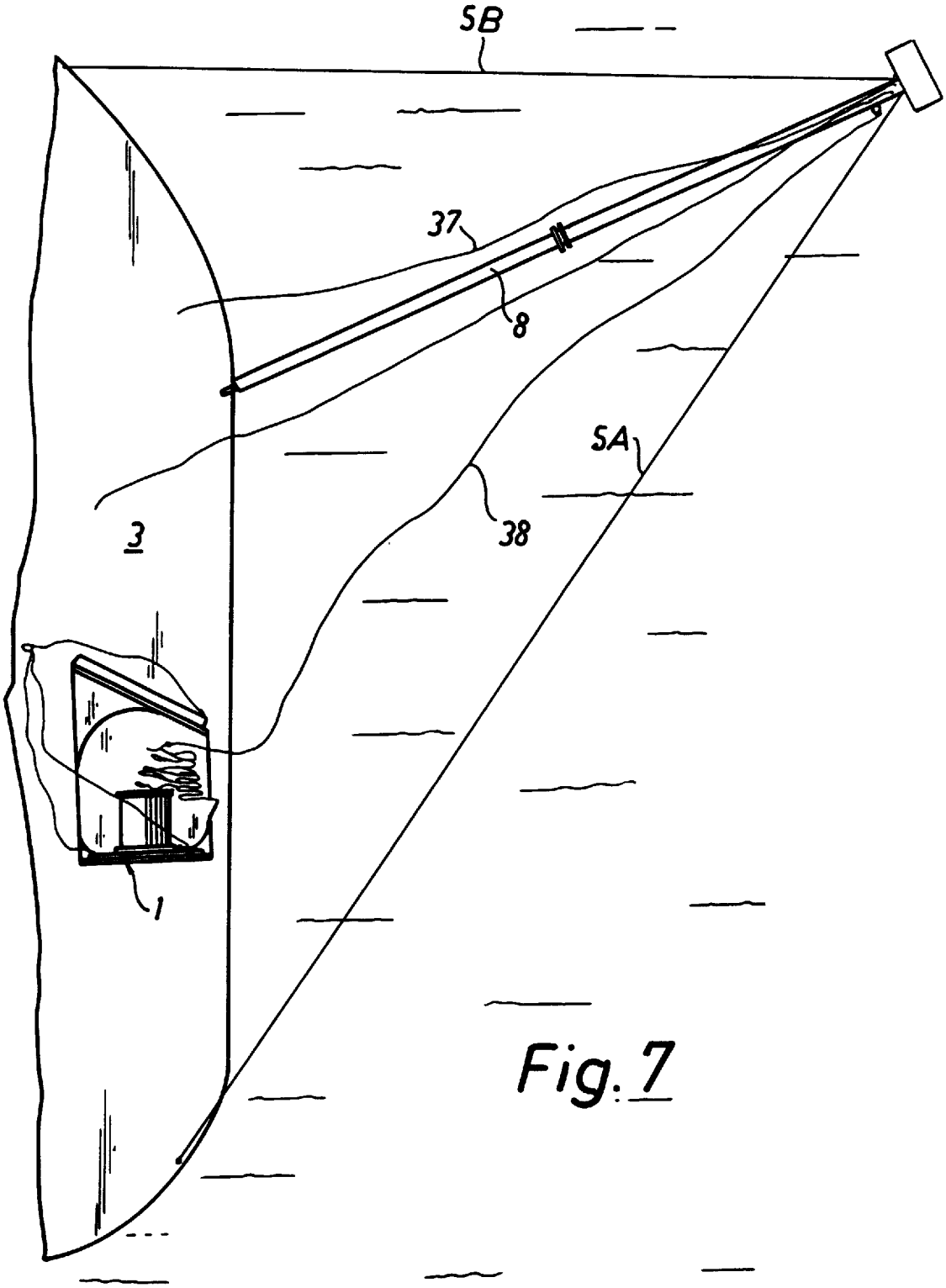
FIG. 7 is a view from above of the device in accordance with FIGS. 1–3 prior to positioning the collection container in the water.
Figure 8:
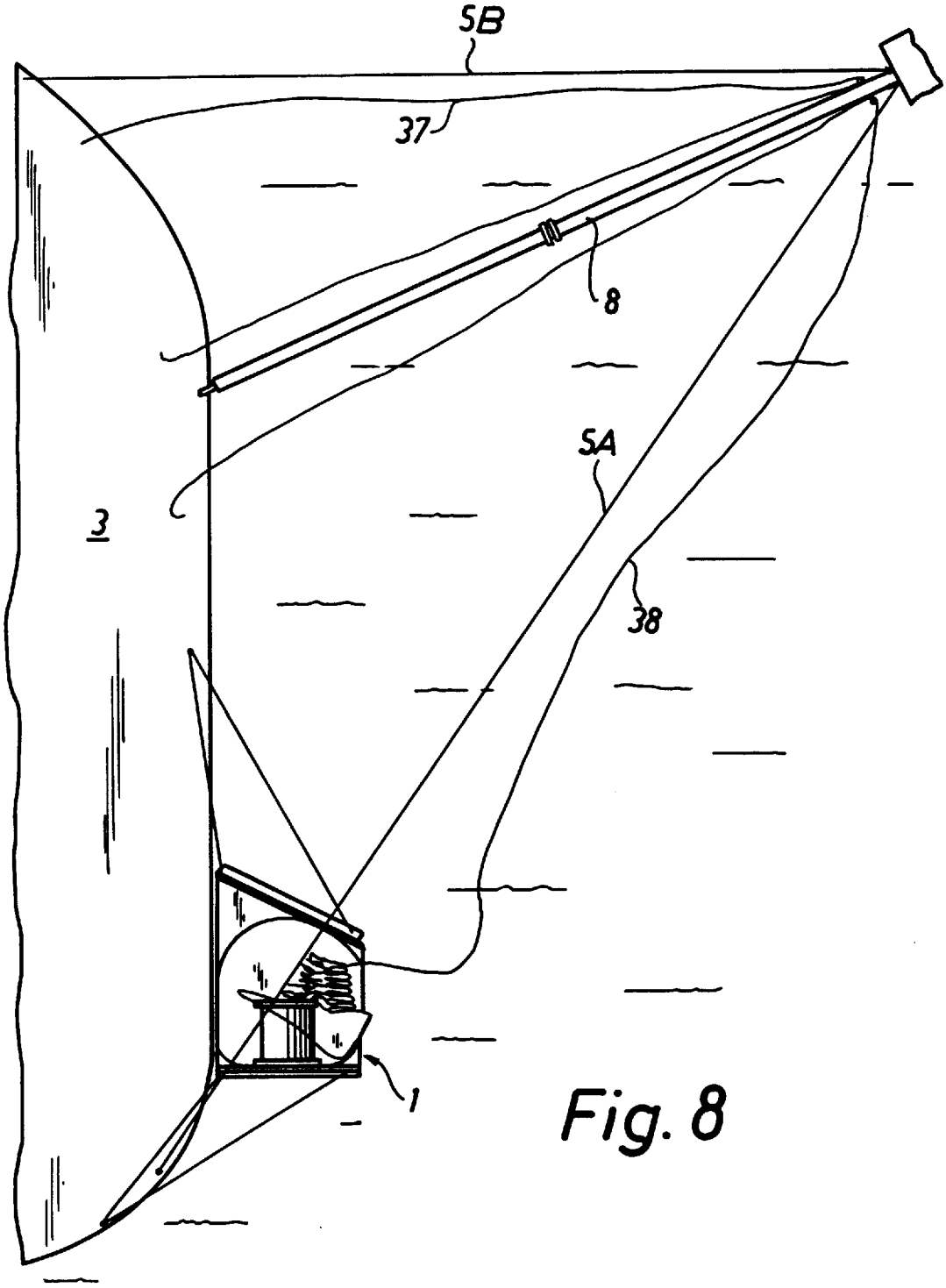
FIG. 8 is a view from above of the collection container anchored to the vessel side prior to the positioning of an oil boom serving as trapping device.
Figure 9:
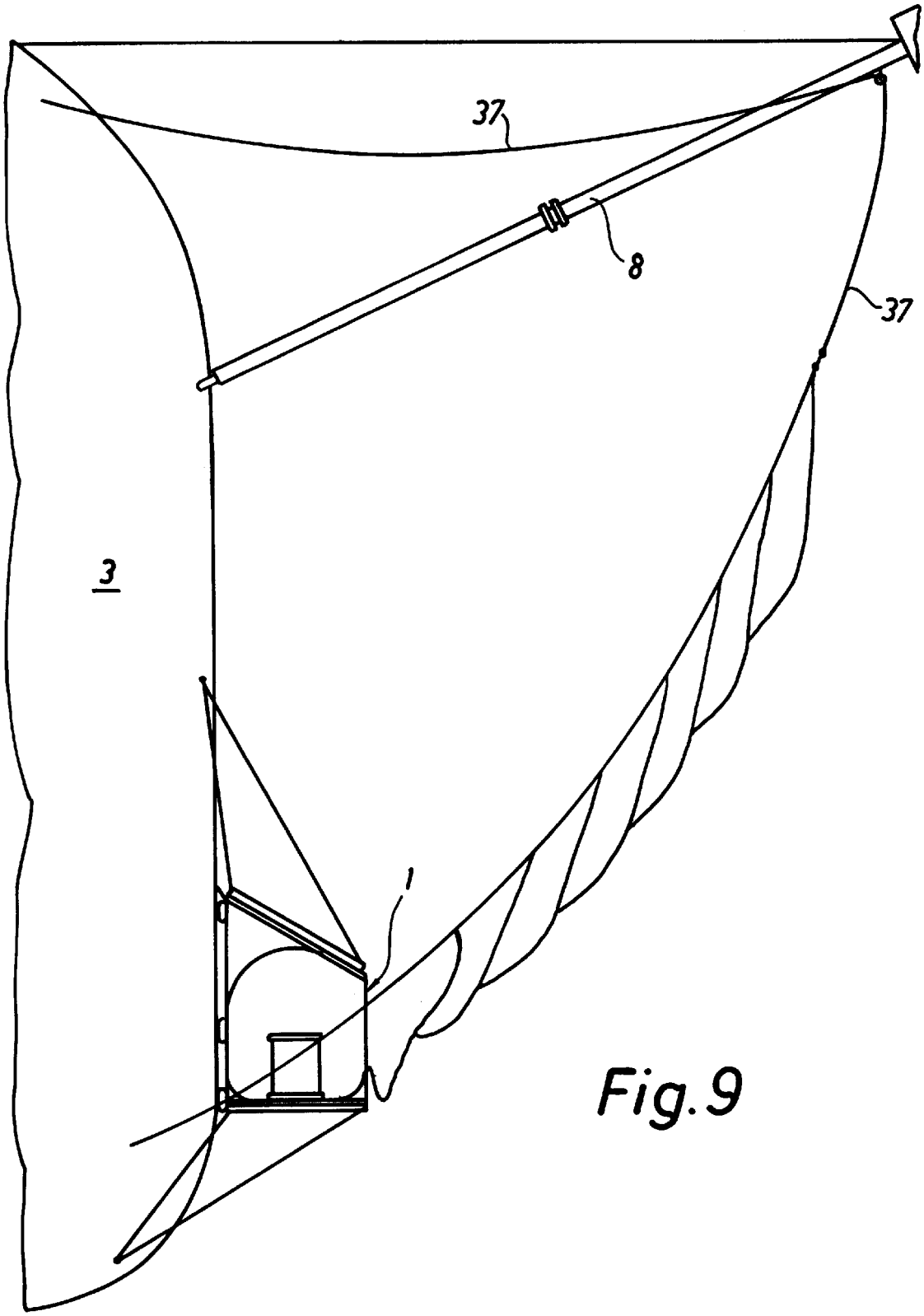
FIG. 9 is a view from above corresponding to FIG. 8 showing the oil boom partly put in place.
Figure 10:
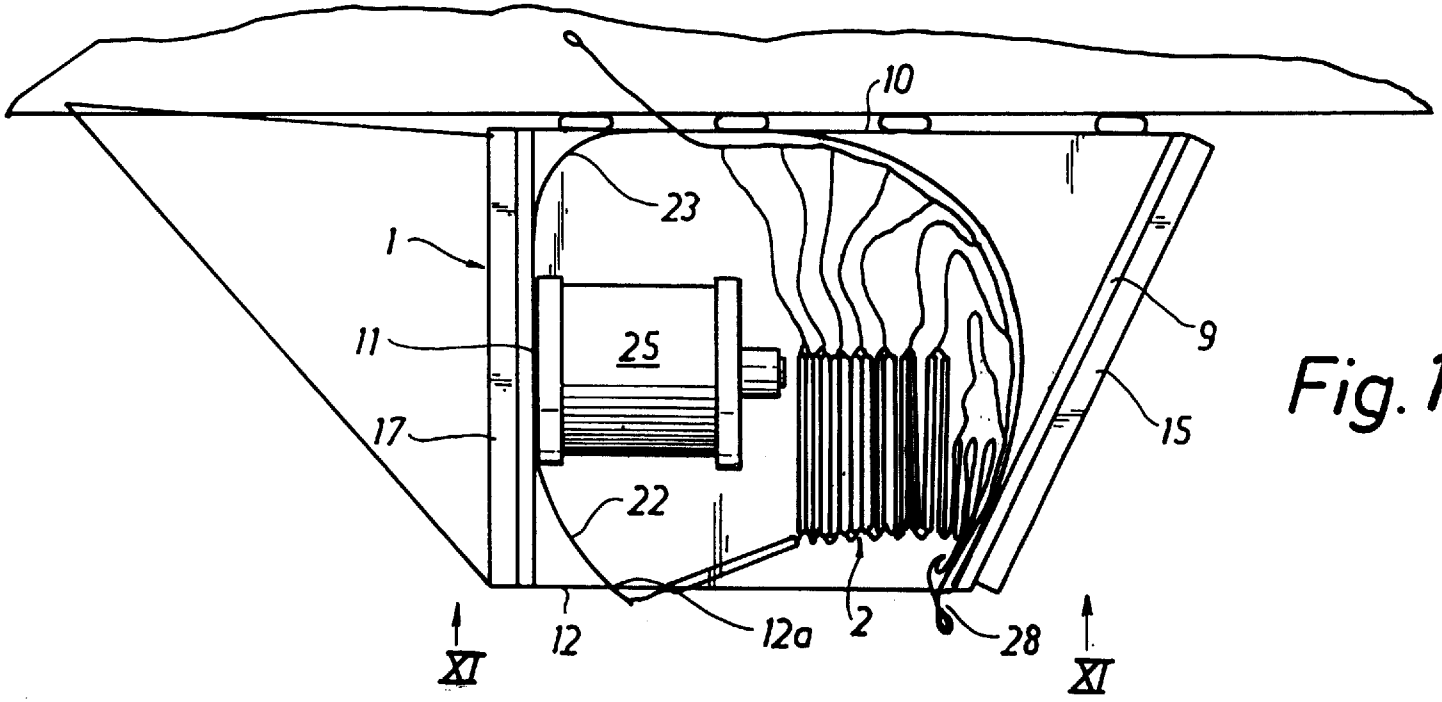
FIG. 10 is a view from above similar to FIG. 2, of the device in its inactive position, i.e. with the oil boom stored inside.
Figure 11:
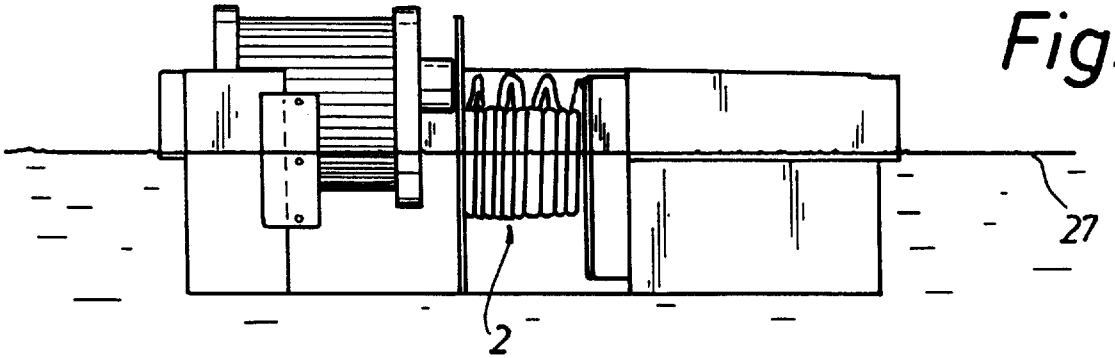
FIG. 11 is a lateral view as seen in the direction of arrows XI in FIG. 10.
Figure 12:
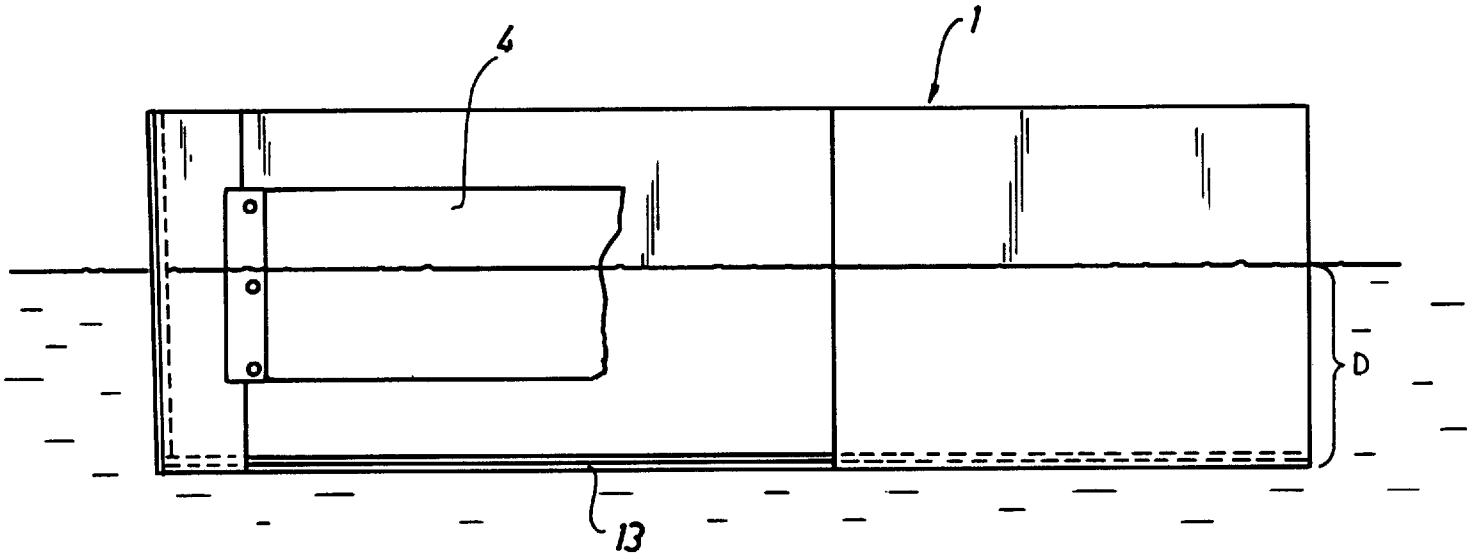
FIG. 12 is a lateral view in the direction of arrow XII in FIG. 1 of the collection container including the associated trapping device of which only the portion pertaining to the collection container is shown.

FIG. 1 illustrates, as mentioned in the aforegoing, the rotational or circulating unit anchored alongside a vessel with the oil boom 2 in an outrigger position by means of a spacer boom, a so called jib boom. In this case a rotating drum skimmer, positioned in the water in-flow from the oil boom to the rotational unit, is used whereas in FIGS. 5 and 6 is shown a screw skimmer positioned approximately in the middle of the rotational unit and the rotating water including the oil rotates around the screw skimmer. The rotational unit allows most types of screw skimmers to be used therein since they are allowed to work in more stagnant waters, because protected by the rotational unit walls. When the device is not in use the collection container can be stored on deck, as illustrated in FIG. 7, or on the vessel side wall as illustrated in FIG. 10 with the oil boom positioned inside. When the device is positioned in the water the oil boom may be pulled towards the free end of the outrigger boom with the aid of a line 37 travelling over a suitable deflection means at the free end of the outrigger boom 8. In FIG. 9 the oil boom is illustrated in a partly extended position.

Figure 14:
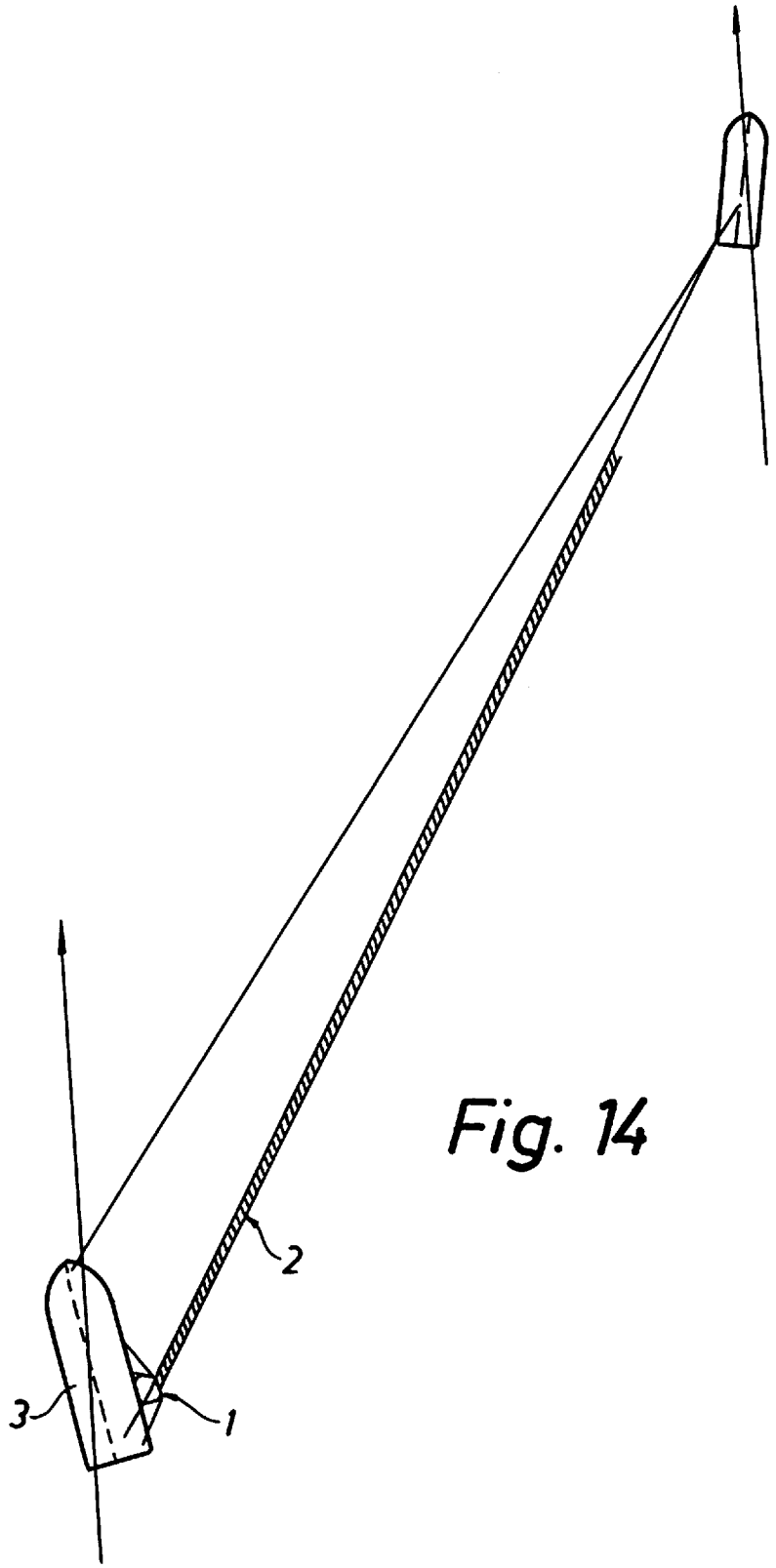
FIG. 14 is a view from above of the device extended between two vessels.

FIG. 14 illustrates the rotational unit 1 used in connection with a so called two vessel sweep in order to create a larger sweeping area.

Figure 15:
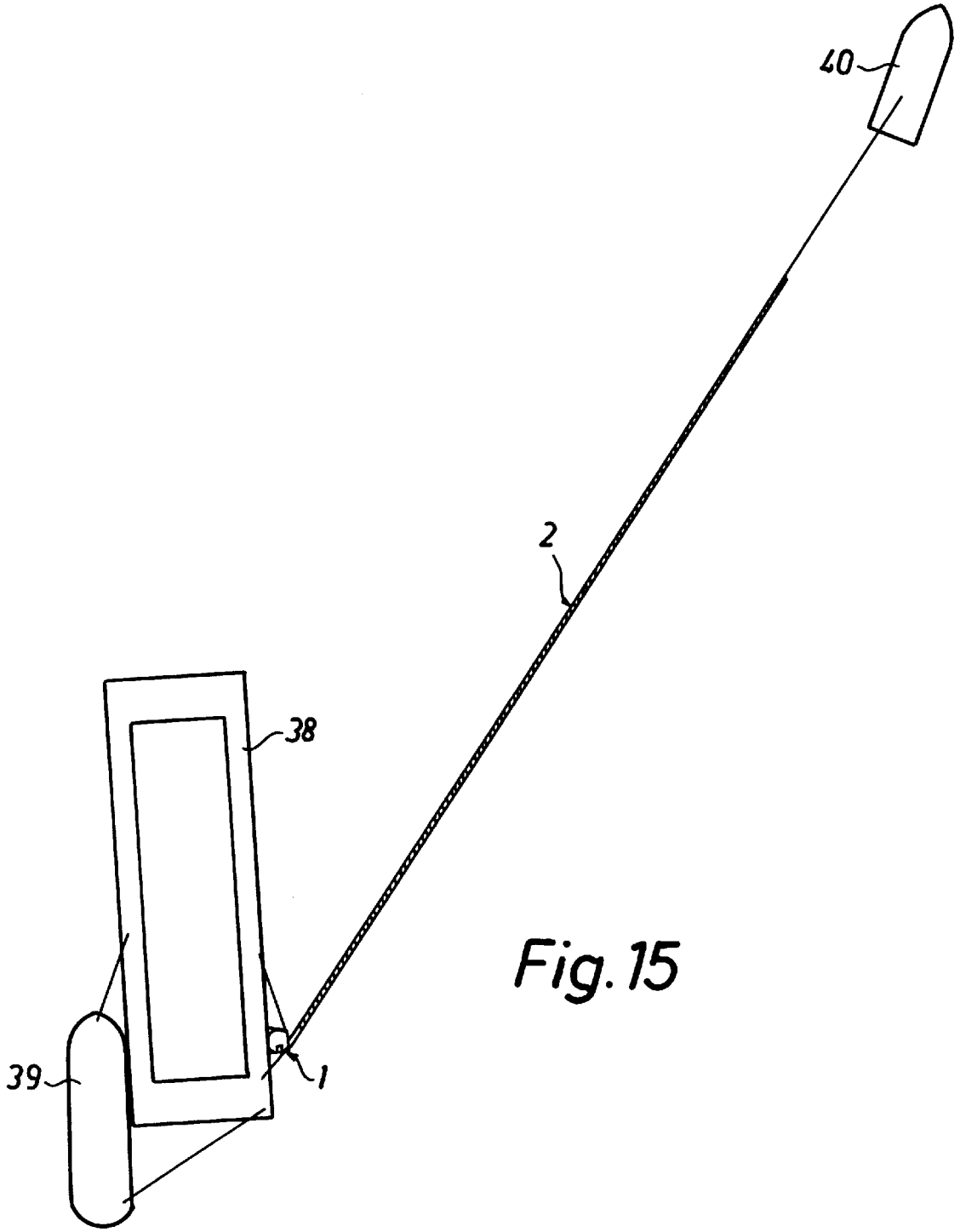
FIG. 15 is an alternative of FIG. 14, showing the device extended between a vessel and a barge.

It is often difficult to find suitable tanker tonnage for the oil etc removed. In these cases it is possible, as illustrated in FIG. 15, to use dredge barges or barges having containers on its deck. Numeral reference 38 designates a barge of this kind and numeral references 39 and 40 designates two tow-boats one of which supports the outer end of the trapping device 2 or oil boom and the other one 39 of which is anchored to the barge 38 to tow the latter forwards in the water. In this case the collection container 1 is anchored to one side of the barge 38. This could be an inexpensive and satisfactory way of performing oil clearing operations.

The rotational unit, i.e. the collection container, preferably is manufactured from e.g. aluminium plate. Its front and rear walls preferably are manufactured from double aluminium plate enclosing an intermediate water tight empty space to allow the rotational unit to serve as a float. As a reserve displacement it is likewise possible to weld on supplementary floats on the front and rear container walls. As appears from the drawing figures the illustrated drum skimmer has a small draught below the water level, with consequential minimum flow resistance to the water entering from the oil boom.

The rotational unit is designed with bottom and wall elements that could be reversed mirror fashion or, if the unit itself is reversible it can be used positioned on the starboard as well as on the port side of the vessel, should this be required owing to weather, flow, or other conditions. This reversibility could also be useful in watercourses, since it allows optional positioning at the left hand or at the right hand bank of the watercourse.

Figure 16:
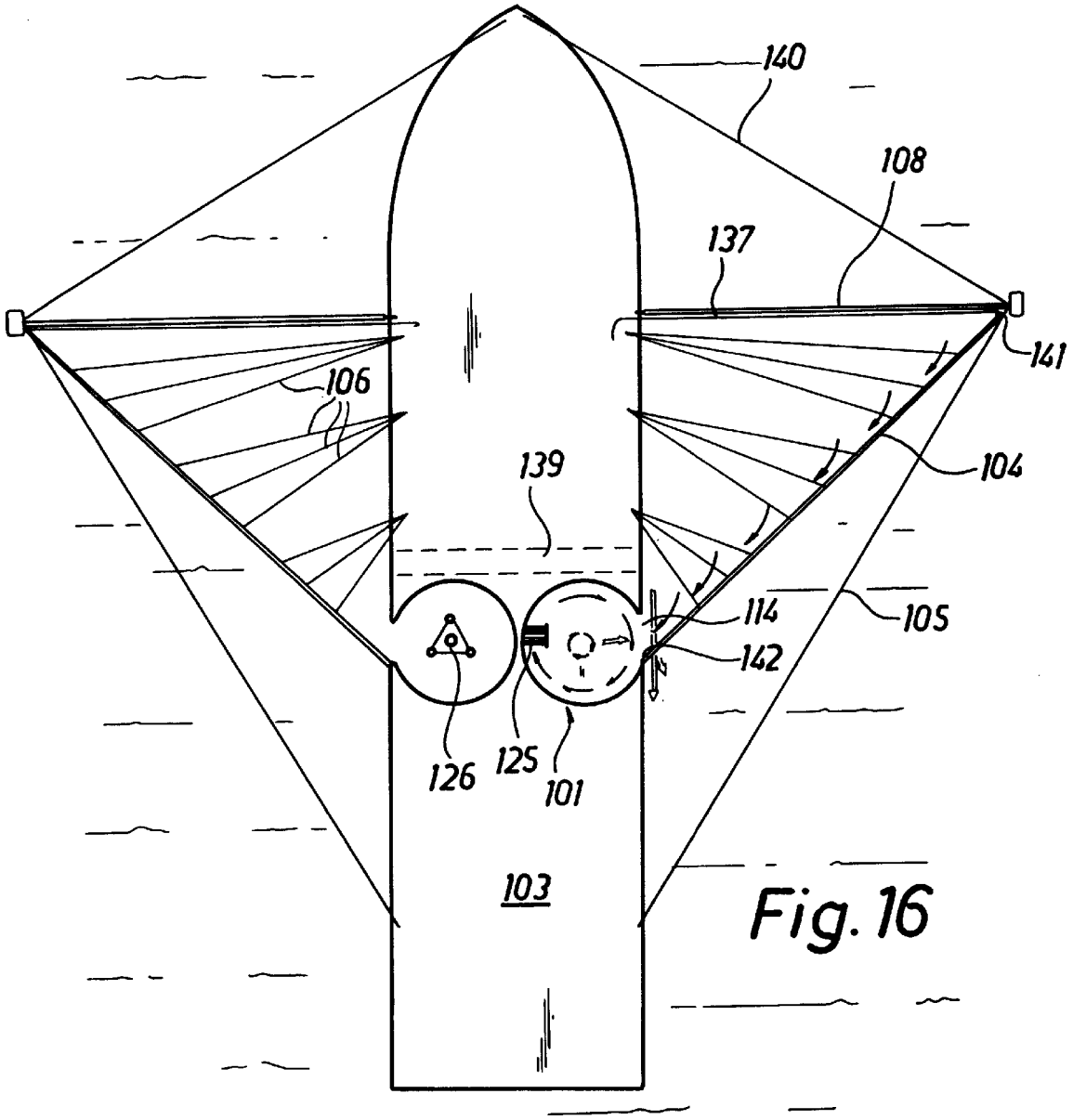
FIG. 16 is a schematical view from above of a vessel integrated with the collection device in accordance with the invention.
Figure 17:
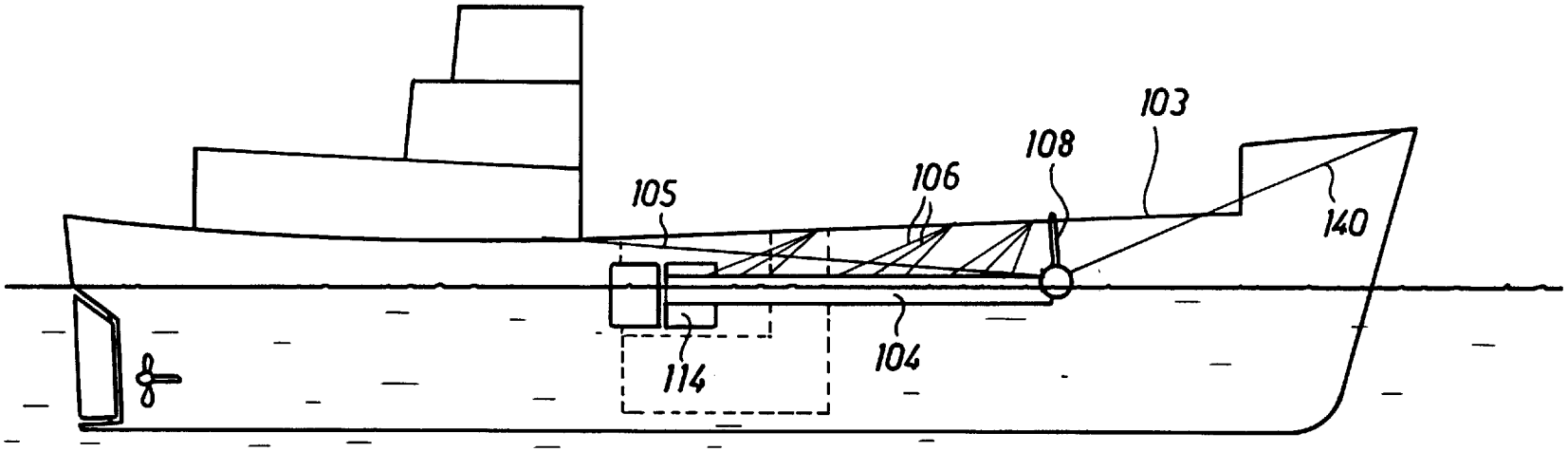
FIG. 17 is a lateral of said vessel.
Figure 18:
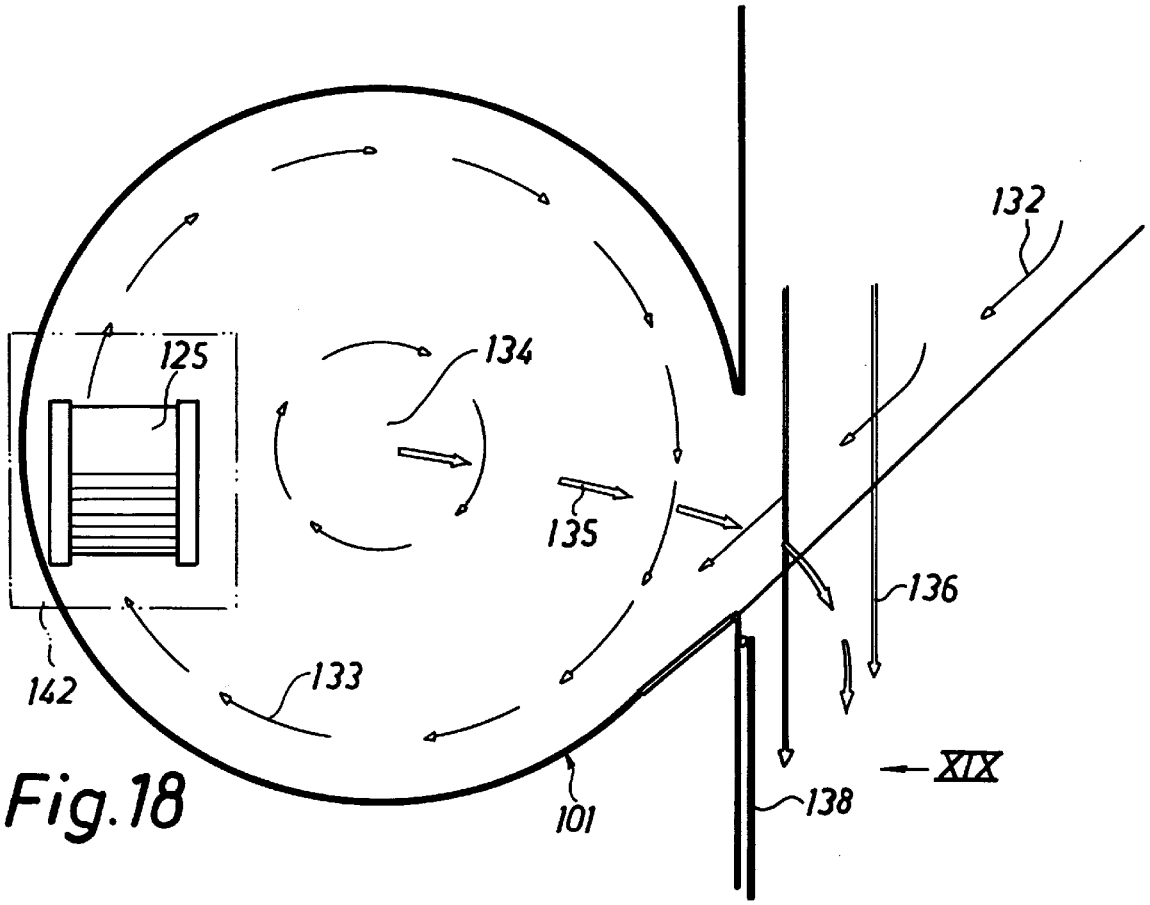
FIG. 18 is an enlarged view from above of a portion of the device illustrated in FIG. 16.

FIG. 16 illustrates the invention applied in such a manner that its collection container 101 is intergrated in the hull interior of the vessel 103, the inlet opening 114 being arranged in one flank of the hull. In accordance with the embodiment illustrated, one collection container is arranged in each side of the vessel, although in some cases it might be sufficient to arrange the collection container in one of the vessel sides. Like in the previously embodiments a spacer boom 108 or so called jib boom extends from the side of the vessel. The free end of the spacer boom 108 is maintained in position by means of tensioning lines 105, 140 extending respectively in a direction towards the aft and towards the fore, the opposite ends of said lines being attached to the aft and the fore portions respectively of the vessel. Numeral reference 104 designates an oil boom which from the aft edge of the opening extends up to the outer end of the spacer boom 108. The oil boom 104 is maintained in the desired position by means of staying lines 106 extending between the vessel and the oil boom. As most clearly apparent from FIG. 18 the inlet opening could be covered to the desired degree by means of a hatch 138, for instance a sliding hatch.

Figure 19:
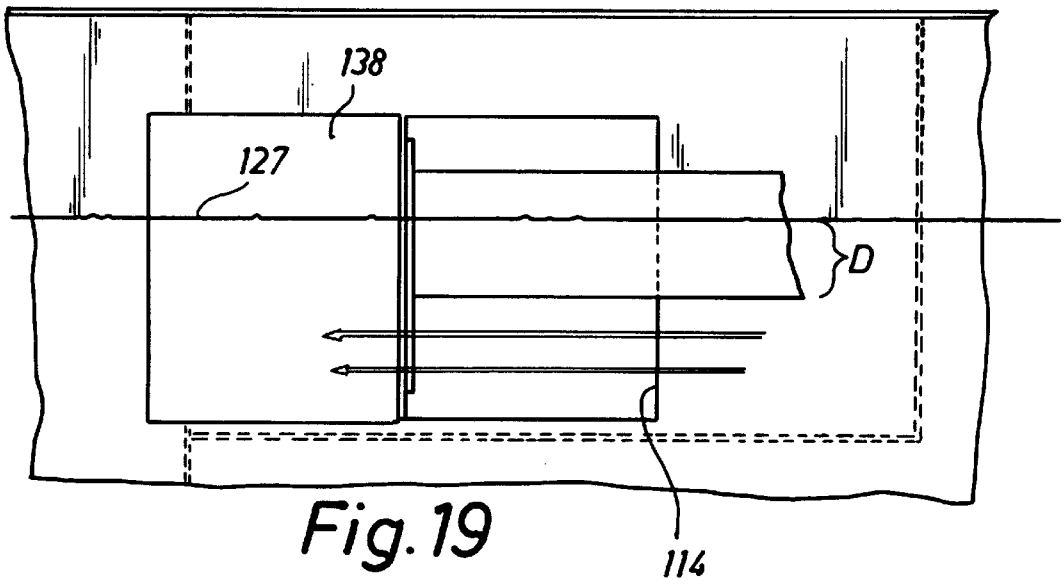
FIG. 19 is a lateral view as seen in the direction of arrow XIX in FIG. 18.

Also when the collection container 101 is positioned in the interior of the vessel hull its function is essentially identical with the one described primarily in connection with FIG. 13 in accordance with the embodiment above. In consequence thereof the flow of water along the oil boom is designated by reference 132, the one alongside the vessel side by 136, the water flow circulating inside the collection container by reference 133, the centre of the water whirl by 134 and the water flow exiting from the collection container bottom by 135. Reference 125 designates a drum skimmer arranged to remove substances intended to be separated from the circulating water whirl. As appears from FIG. 19 it is also in this case suitable to form the oil boom 4 with a smaller draught D than the outlet opening 114. The device illustrated to the left in FIG. 16 is designed in a manner corresponding to the device to the right, with the exception that in this case a screw skimmer 126 is shown which is positioned in or close to the centre of the water whirl created in the rotational tank formed by the collection container. Preferably, the substances removed by devices 125 and 126 may be transported to storage tanks 139 positioned inside the vessel hull. It is within the scope of the invention to impart to the rotational tank another configuration than the circular shape illustrated. Thus, it could have an oval, a square as well as a rectangular shape. Preferably, the hatch 138 is closable in a water-tight manner, thus forming a lid sealing off the inlet opening in the hull flank when the device is not used. Thanks to the possibility of closing this sliding hatch to a varying degree, the opening towards the inflow water and oil etc and for water outflow from the vortex may be varied as to its size and consequently the inflows and outflows be varied. The draught of the drum skimmer 125 could be varied to maximize the water flow. The most advantageous position of the skimmer is, as illustrated in the drawings, close to the rotational tank. The screw skimmers 126 could advantageously be positioned in or close to the centre of the vortex generated in the rotational tank, as illustrated in FIG. 16. Reference numeral 137 designates a pulling-out line and by 141 a corner block for pulling-out the oil boom from its inactive position of transportation inside the collection container 101 to its active position. By reference 142 is designated an attachment for securing the oil boom to the inlet opening. Numeral reference 127 designates the water-line in FIG. 19. In case the inlet opening need not be regulated the hatch 138 may be pivotally connected to the aft opening edge by means of suitable hinges. By reference 142 is designated a manhole cover provided in the vessel deck for allowing servicing of the equipment. Normally, drum skimmer 125 requires a draught of only 5–10 cm to be operative, which as mentioned above only to a minimum degree affects the rotating flow field.

For several years it has been known to make use of built-in tanks in vessels with the tank openings formed in the vessel hull to let in oil-polluted water for separation and removal of the oil. For example, when the oil drilling operations started in the North Sea several such systems were under development and also other systems have been developed.

It is known to position tanks on either side of the vessel, said tanks being provided with one fore and one aft port/hatch and with one oil boom guiding/directing water and oil in through the aft port in the tank. Water and oil then flow through the tank and out through the fore port while at the same time oil is being removed from the water surface as the water and oil flow through the tank, with the aid of oil-removing means positioned inside the tank. Any oil that may pass past the oil removal means is entrained with the water and flows out through the front port and owing to the speed of the vessel through the water it is entrained with the water on the outer face of the vessel and is returned to the aft port. Any oil that might not have been removed circulates from the aft port, through the tank, out through the fore port, returns back to the aft port through which it enters the tank again to be removed by the oil skimmer. Consequently, half the circulating cycle takes place externally of the vessel. Owing to the present invention, on the other hand, the oil is forced to circulate inside the tank until removed by the oil removal device positioned therein. This is achieved because the built in tank in the vessel is provided with only one port/hatch in the vessel flank and water as well as oil are forced to rotate/circulate inside the tank until the oil has been removed by the oil removal device. This is made possible because the rotational/circular movement of the water creates a slow-moving vortex owing to the downwardly flow of which inflow water through the single port of the tank is also evacuated along the tank bottom via the same port. This outflow of water along the tank bottom is enhanced by the ejector effect created by the water which owing to the sweeping speed passes below the oil boom at the port. The effect thereof is strengthened when the oil boom has a smaller draught than the opening of the port. An advantageous feature found in this arrangement in the vessel hull compared with prior-art oil removal vessels is among other things the low costs of installing one single port/opening in the tank. This should be compared with the costs for reinforcement of the vessel hull which increase significantly as the number of ports increases. Another economical advantage compared with prior-art constructions is the greater liberty in the choice of the oil removal means that may be positioned at the centre of or at the edge of the vortex created in the tank centre. Removal may be performed efficiently if the removal means also has but a small surface extension on the expanse of water. For the water current is too strong in tanks having two ports, wherein the water and the oil are to pass through the tank, to allow use of skimmers of the conventional types available on the market. It would be advantageous when using the device in accordance with the invention to utilize so called screw skimmers in the strongest flow along the side/sides of the tank to which areas the centrifugal force urges the oil. As also mentioned in connection with the above embodiments sweeping operations at high sweeping speeds are made possible because the oil is directed into the tank by means of an oil boom extending at an angle to the sweeping direction through the port of a tank, wherein the oil is forced to co-rotate with the rotating water inside the walls of the tank until the oil is removed by means of suitable removal devices, such as a skimmer. Thus, the oil is forced into and to remain in a closed system until it is entirely removed from the water inside the tank.

Figure 20:
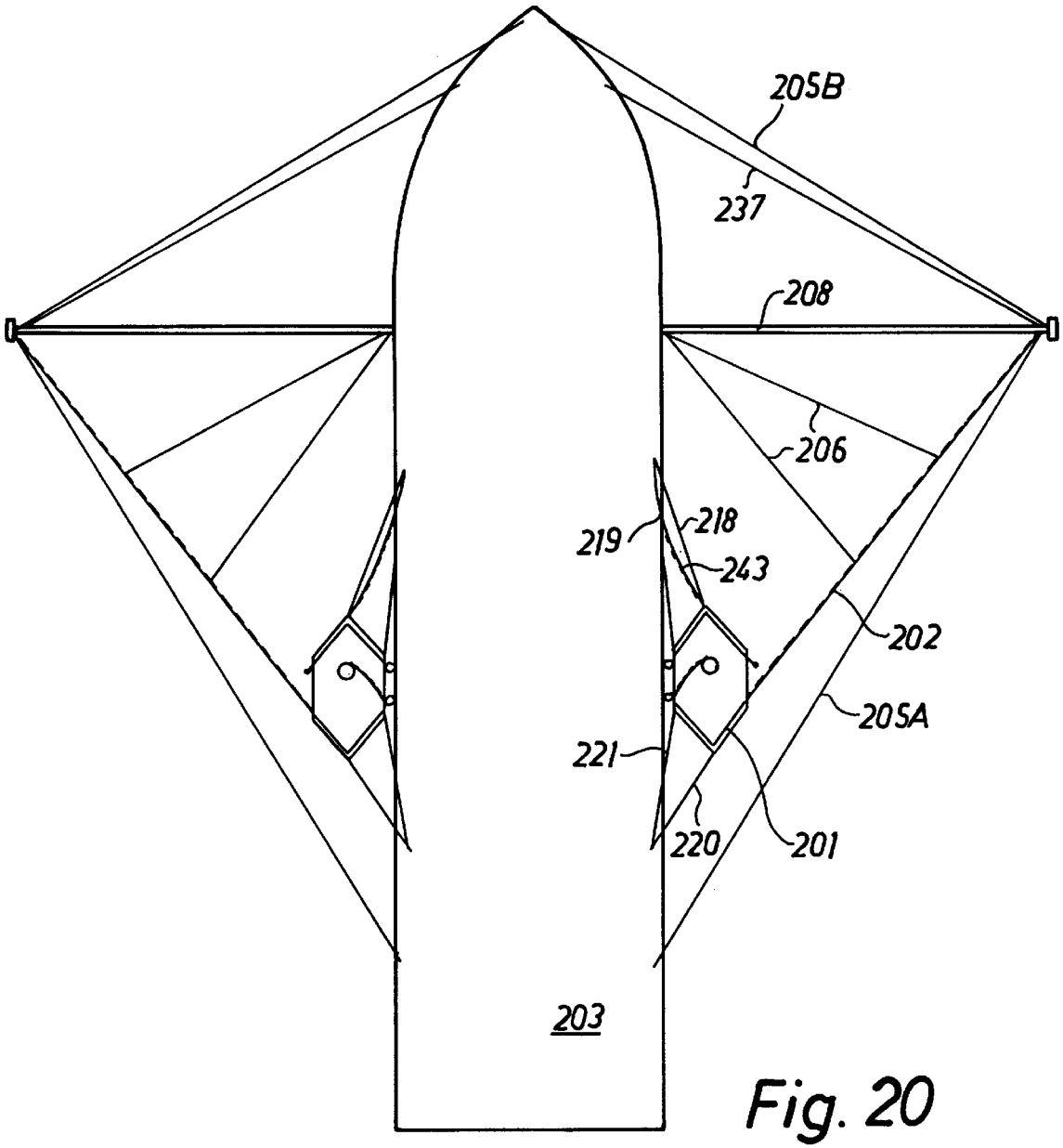
FIG. 20 is a view from above corresponding to FIG. 16, of a further alternative embodiment of the device in accordance with the invention according to which the collection container and the trapping devices are positioned on the external face of a vessel.
Figure 21:
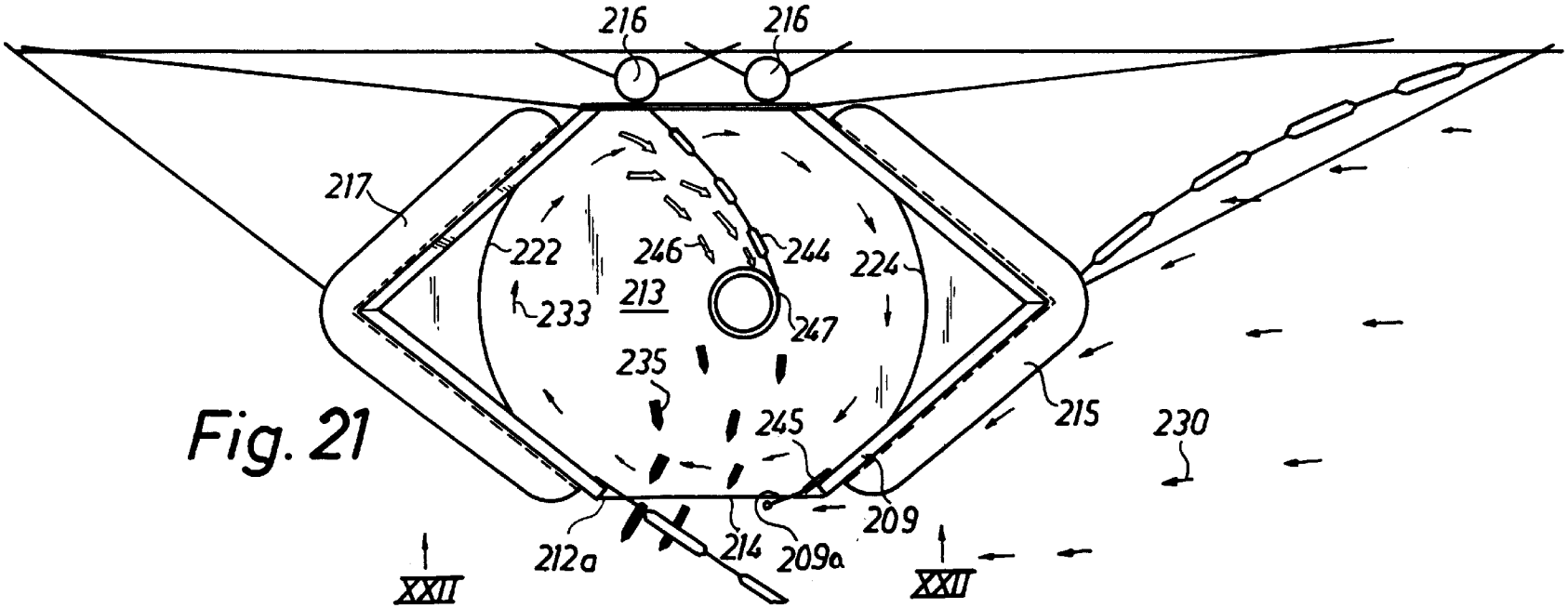
FIG. 21 is a corresponding view from above of a detail in accordance with FIG. 20, shown on an enlarged scale and with the directional flows indicated.
Figure 22:
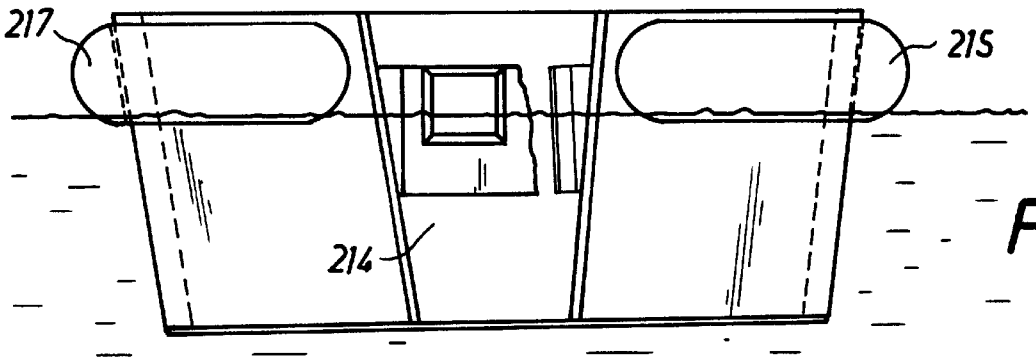
FIG. 22 is a view in the direction of arrows XXII in FIG. 21.

In FIGS. 20–22 a vessel is designated generally by reference 203, a collection container anchored to each one of the two vessel sides by 201 and catching oil boom extending therefrom outwardly and obliquely towards the stern by 202. Numeral reference 208 designates a spacer boom, a so called jib boom projecting from the vessel side. The spacer boom 208 is maintained in position by means of one aft and one fore staying line 205A and 205B respectively. Numeral reference 206 designates support lines extending from the vehicle hull and maintaining the oil boom in a taut condition and in a vertical position. In accordance with the embodiment illustrated in this drawing figure the collection container 201 has pointed shape aft as well as fore, which means that the collection container is reversible, i.e. it could be used on the starboard as well as on the port side. Consequently, the collection container 201 is identically shaped on both sides and consequently only the collection container on one side will be described herein. By numeral references 205 and 207 are designated floats arranged respectively at the fore and at the stern. The inlet opening is designated by 214, by references 212*a* and 209*a*, respectively, are designated the front and rear delimiting edges of the opening. Numeral references 222 and 224, respectively, designate guide walls bridging the collection container corner portions in order to configure the flow field of the water. These guide walls could be made e.g. from a plastic cloth, rubber or metal. The bottom of the collection container is designated by 213. Numeral reference 216 designates fenders provided on the vessel side so as to protect the vessel flank from scuffing. Numeral references 220 and 221 designate aft interconnection lines which maintain the collection container anchored to the vessel flank in the aft direction and by references 218 and 219 are designated anchoring lines secured in the fore direction. Numeral reference 243 designates a protective oil boom positioned ahead to prevent oil passage between the vessel and the collection container. It should be pointed out that the device being described likewise could be used in connection with the banks of a watercourse instead of in connection with the vessel as shown. Like in accordance with the previous embodiment also the oil boom in accordance with this embodiment could be stored in the collection container when the latter is not being used and be extracted therefrom in principally the same manner as described above. The collection container illustrated in FIGS. 20–22 has downwardly tapering configuration, as most obviously apparent from FIG. 22. Numeral reference 244 designates guide oil boom extending from the periphery of the collection container towards the container centre, said boom preferably having a small draught in order to direct oil from the circulating-flow field to the centre of the container, where a suitable removal device, such as e.g. a skimmer, may be provided. Also in accordance with this embodiment a drum skimmer could of course be used. The floats 215, 217 could be made for instance from foamed polyethylene or be made from inflatable units of rubber or PVC-cloth. By numeral reference 209*a* is designated a flap which could be used as a flow deflector or to vary the inflow aperture size. Numeral reference 245 designates an attachment fitting to which the oil boom 202 alternatively may be attached, when the collection container is positioned on the other side of the vessel. Numeral reference 230 designates the water flow towards the inlet opening 214 and reference 233 designates the water flow circulating inside the collection container whereas numeral reference 235 designates the outgoing flow of water, devoid of the substances in question and leaving the collection container at the bottom thereof. By reference 246 is designated the part flow which the oil boom 244 deviates away from the circulating flow, towards a centrally positioned removal device 247, for instance an oil skimmer. Numeral reference 237 designates a haul-out line to be used together with the oil boom.

In oil clearing work, for instance at sea, the work often need to be carried out during very severe weather conditions. For this reason it is desirable that the device, particularly the rotational unit, is very sea-worthy, has considerable reserve displacement and is able to closely follow the movements of the oil vessel. This is achieved in accordance with the embodiment illustrated in that the front as well as the rear walls are given a pointed configuration resembling that of the vessel and in that manner they obtain an increasing displacement as the rotational unit faces the sea. Because the identically shaped ends of the rotational unit has an inclined configuration the displacement increase is enhanced and the sea-worthiness is improved while at the same time the sweeping speed or the water flow tends to press the rotational unit upwards on account of the sloping prow. Water flowing past externally of the rotational unit towards the oil boom prevents the oil present on the water surface inside the rotational unit from being ejected from the latter on account of the centrifugal force as long as the rotational unit is not excessively filled with oil. Like in the previous example the rotational unit draught exceeds that of the oil boom. Water passing past the rotational unit opening thus also in this case creates an ejecting effect that affects the water flowing outwards from the centre of the rotational unit. Remaining functions of the device described with reference to FIGS. 20–22 is similar to those described with reference to previous embodiments and considering that the latter drawing figures are self-evident with respect to function, a more detailed description of functions has been eliminated.

Figure 23:
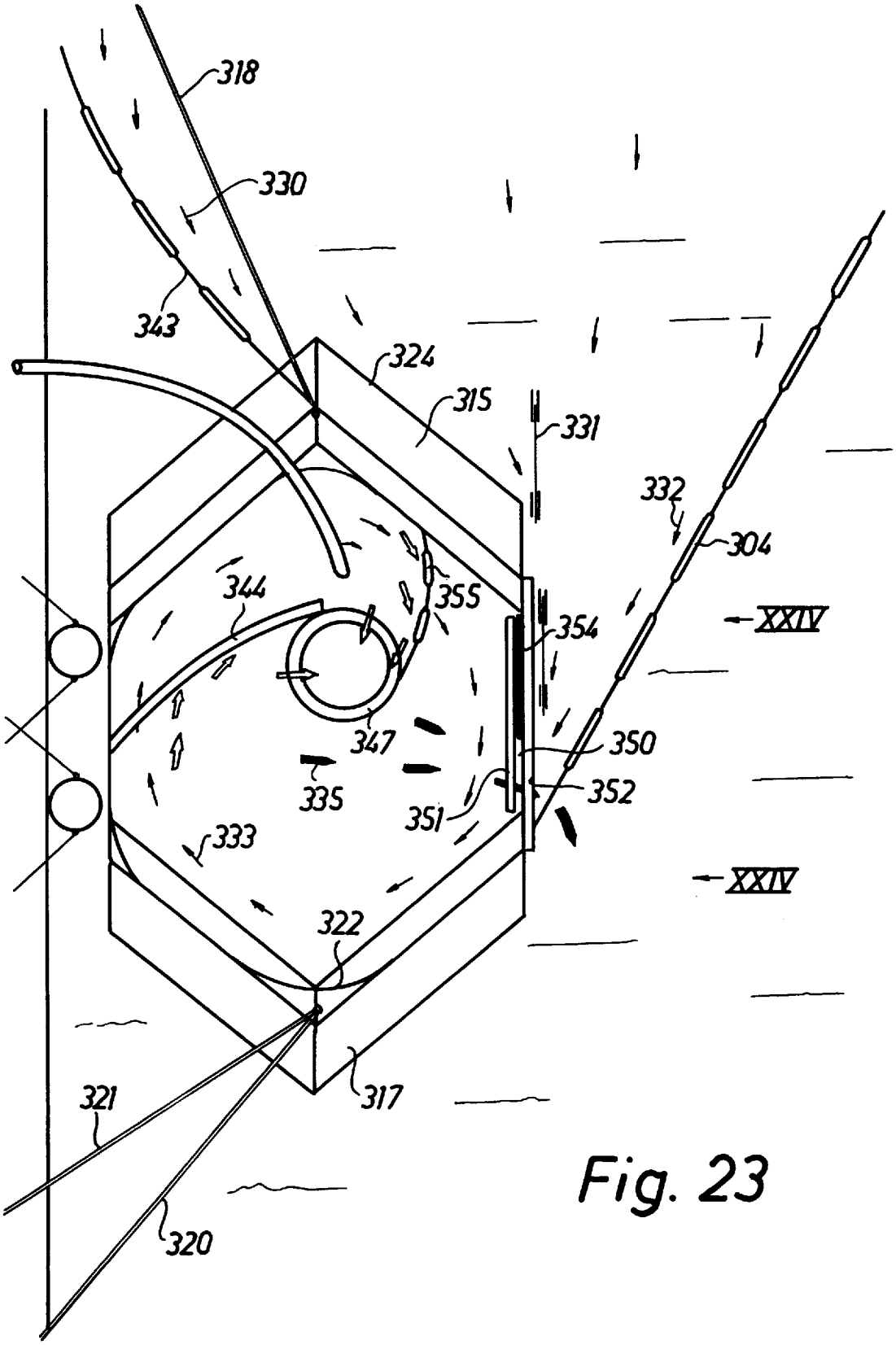
FIG. 23 illustrates a further alternative embodiment of the collection container with associated catching devices associated with a vessel.
Figure 24:
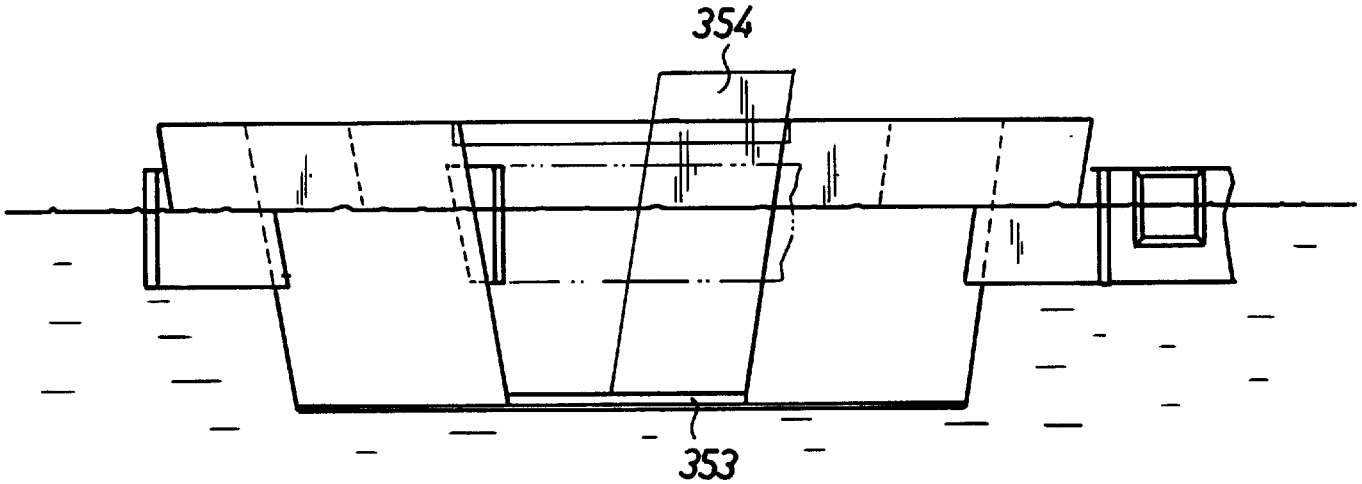
FIG. 24 is a view as seen in the direction of arrows XXIV in FIG. 23.

The collection container illustrated in FIGS. 23 and 24 is distinguished from the one illustrated in FIGS. 20–22 primarily in that in the inlet opening 304 is positioned an inflow regulator 350 comprising a plate 354 which is guided between upper guide rails 351, 352 and lower guide rails 353, by means of which plate the inflow opening may be covered to the desired degree. In addition a further guide oil boom 355 is provided to direct a part flow from the periphery of the circulation unit to the central portion thereof, where the removal device 347, preferably a skimmer, is positioned. Otherwise components having similar functions as corresponding components in the above described embodiments have been given corresponding numeral references with the addition of 300. This means that the guide that directs part of the surface layer into the circulating flow is designated by 344, the aft anchoring lines interconnecting the collection container and the vessel are designated by 320 and 321. The anchoring line which interconnects the collection container with the vessel astern is designated by 318. Numeral reference 315 designates floats ahead and numeral reference 317 aft floats. Numeral reference 330 designates the direction of a water flow guided by an oil boom 343 extending between the vessel flank and the front of the collection container. Numeral reference 332 designates the water flow that is guided by the oil boom 304 and numeral reference 331 designates the flow of water moving more or less straight towards the inlet opening. In addition, by 333 is designated the flow of liquid circulating inside the collection container and by 335 is designated the flow of liquid which moves along the collection container bottom and exits through the lower portion of the inlet opening. On account of the otherwise considerable similarities with the circulation chamber illustrated in FIGS. 20–22 a more detailed description of this embodiment is not given.

In case of diesel oil spillage in a watercourse where the water flow speeds varied between approximately 1.0 and 3.5 knots and where oil booms were set out it was found that the energy from the strong current inside the rotational unit gave the circulated water and oil inside the rotational unit a high velocity. The in-flow regulator 354 described above has been constructed to be able to regulate the inflow speed and good results have been obtained. FIG. 23 illustrates the regulator in a position wherein it partly throttles the inlet opening and thus reduces the opening area. Said drawing figure also illustrates the flow field created by the rotational unit when the latter is positioned adjacent a vessel. Owing to this arrangement it becomes possible to manoeuver vessels concerned at very high sweeping speeds. In addition, it becomes possible to operate during severe weather conditions and to sweep away wind and sea and consequently to allow oil clearing work to be performed during weather conditions where such operations normally would have been impossible to perform using prior art technology. Good results have been obtained in tests carried out in wavy seas with crests approximating 1.6 meters. When sweeping against wind and sea the water pressure excerted from the oil boom cooperates with the water resistance and the surface water current created by the wind and the forces from the rotation of the water particles and their acceleration and thus affects the oil boom, its moorings and the vessel. When sweeping in the direction of the wind and the sea the oil boom is affected only by the water resistance—wind resistance and surface water current—caused by the sweeping speed, in addition to the rotation of the water particles. The rotational unit illustrated in FIGS. 23 and 24 is, like the rotational unit illustrated in FIGS. 20–22, configured as an old-fashioned pilot boat having dropping bows providing a satisfactory reserve displacement and reduced water resistance, which is an advantage at high sweeping speeds or in case of strong currents in watercourses in order to prevent the rotational unit from "dipping down". When the rotational unit is anchored in a watercourse instead of in a vessel flank together with an oil boom positioned at a suitable angle to the current the rotational unit simplifies and allows efficient oil clearing work also in such streaming watercourses wherein hitherto it has been very difficult or impossible to perform efficient oil protection operations with the aid of personnel lacking training, knowledge and experience of such operations.

Figure 25:
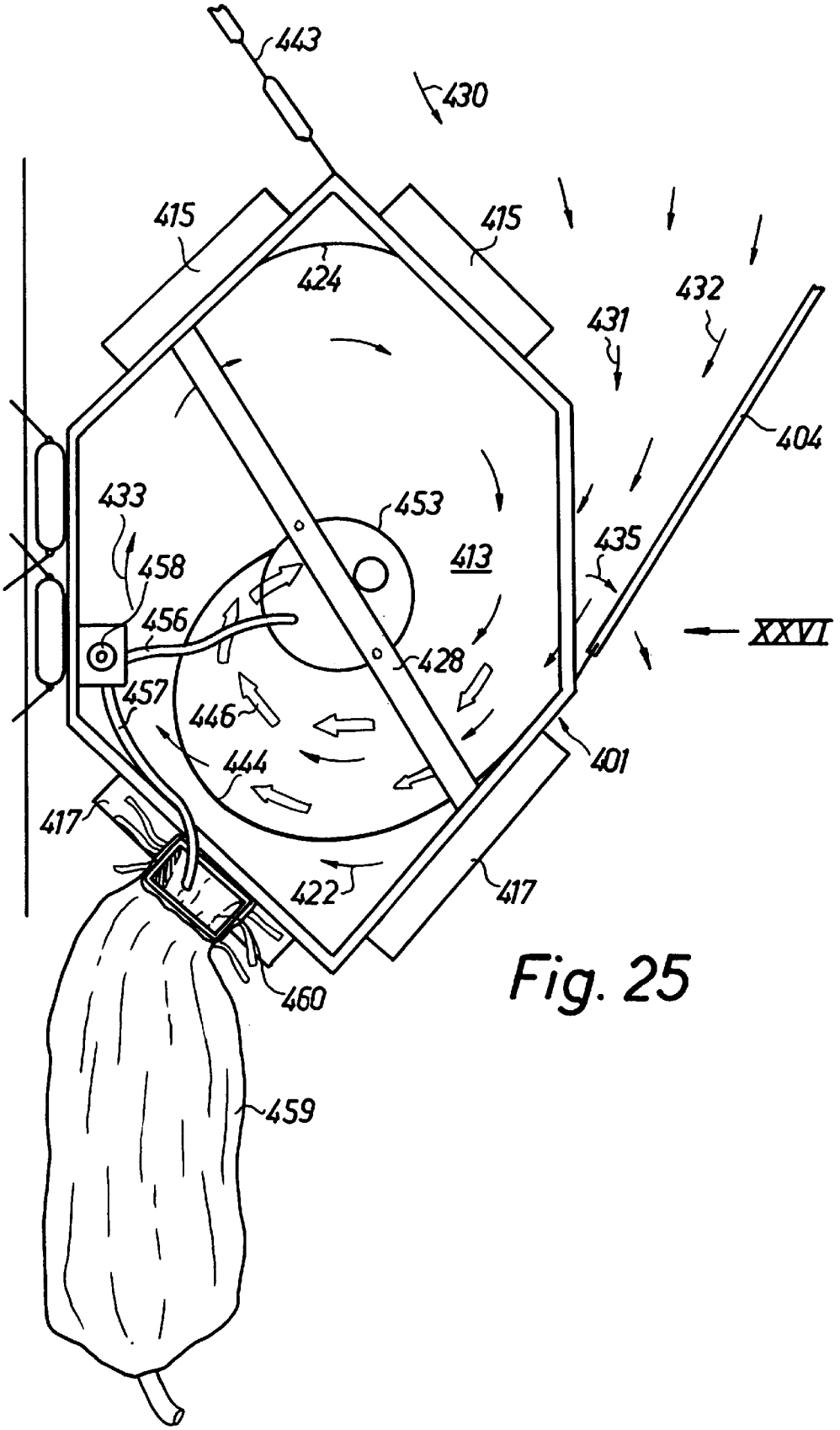
FIG. 25 is a view corresponding to FIG. 23 and illustrates in a view from above a collection container with its associated trapping devices in accordance with a further embodiment.
Figure 26:
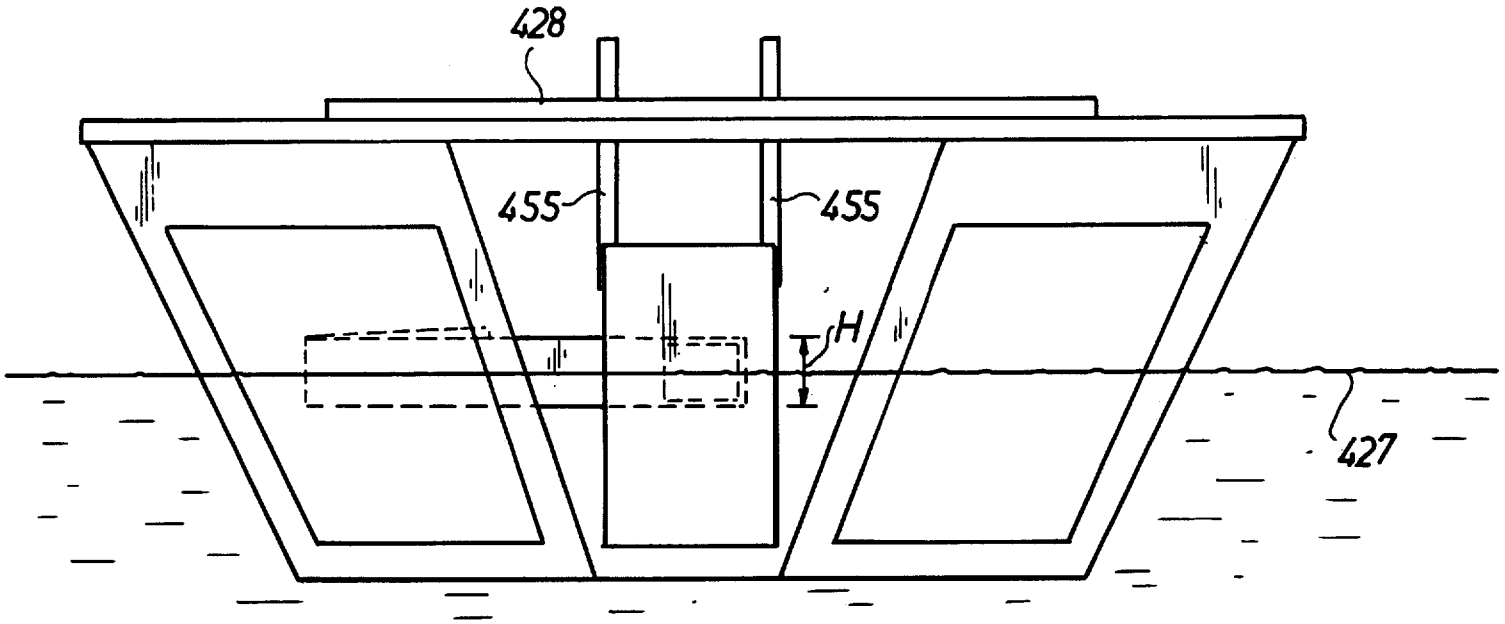
FIG. 26 illustrates the same device, some parts having been removed, and seen in the direction of arrow XXVI in FIG. 25.
Figure 27:
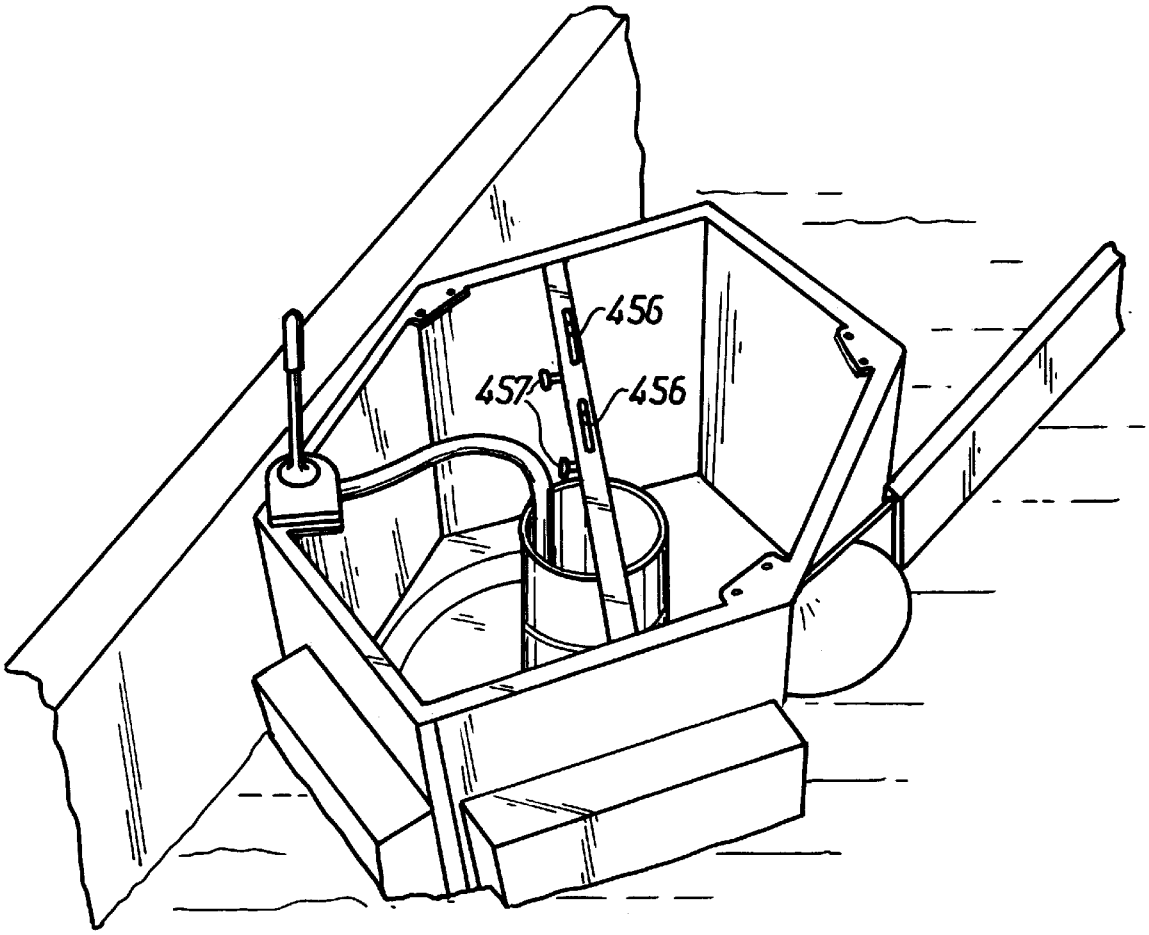
FIG. 27 illustrates the same device in a view as seen obliquely from above and FIG. 28 is also a perspective view as seen obliquely from above of some components incorporated in the collection container, particularly with respect to the device for removal and transportation of oil from the collection container.
Figure 28:
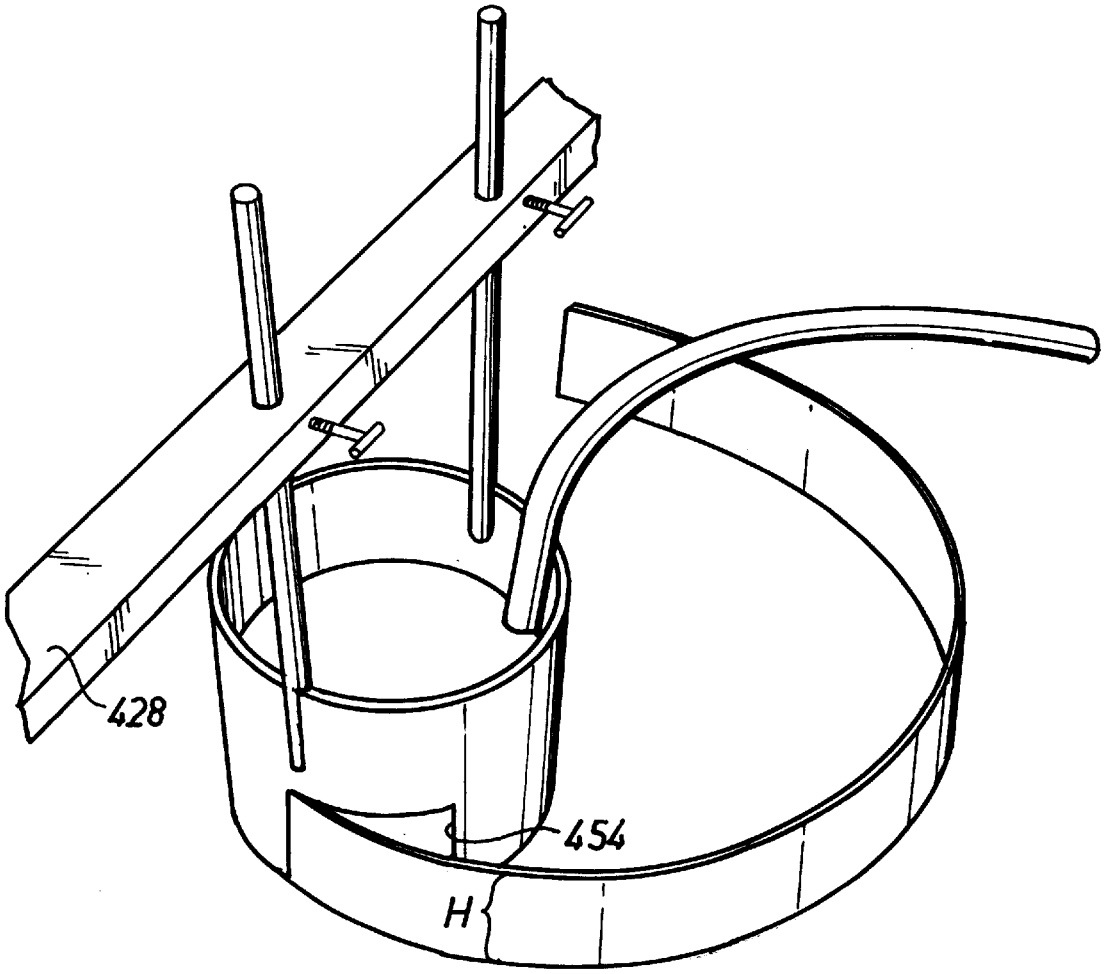

The collection container illustrated in FIGS. 25–28, which like in accordance with the previous embodiments forms a rotational unit or circulation chamber in order to separate and remove from the water substances such as for instance oil, has an external shape which essentially corresponds to the shape of the devices described in connection with the drawings FIGS. 20–24. This means that the collection container has a pointed aft as well as fore configuration, and consequently that the container is reversible and thus may be used on any one side of a vessel or at the desired bank in a watercourse. In this case the oil boom is designated by reference 404, the fore floats by 415 and the aft floats by 417. Preferably, the corners of the rotational unit are bridged by arcuately curved wall members 422 and 424 just like the inner wall members 322 and 324 in FIG. 23 and 222 and 224 in FIG. 21, even if the device will operate well without such members. In the centre of this circulation chamber formed by the collection container a further, central circulation chamber 453 is arranged, said further circulation chamber preferably having a cylindrical envelope wall but no bottom. Numeral reference 444 designates a guide means which from a point in the inlet opening extends along a helical curve up to the central circulating chamber 453. As illustrated in FIG. 25 the guide means preferably is essentially parallel with the oil boom 404 in the area of the inlet opening, i.e. it is essentially tangential to the adjacent wall of the collection container. Likewise it joins the envelope of the central circulation chamber 453 essentially tangentially and, in the flow direction, ahead of the point where the guide means joins the central circulation chamber its envelope wall is formed with an inflow opening 454. As most clearly apparent from FIGS. 26 and 28 the guide means has a limited height H, and consequently draught, in relation to the water surface 427. Numeral reference 428 designates a suspension bracket extending above the collection container 401 and from which depend two carrier rods 455 which are vertically displaceable and possibly also laterally displaceable in two corresponding holes 456 formed in the bracket. The rods are adjustable as to their vertical position and possibly also with respect to their laterally position of displacement by means of tightening members 457. The tightening members 457 thus are used to set the height of the central circulation chamber and possibly also its lateral position or displacement. Numeral reference 443 designates an oil boom associated with the vessel flank and serving to prevent oil and other substances floating on the water from passing between the collection container and the vessel flank. Numeral reference 430, 431 and 432 designate the water flow towards the inlet opening and numeral reference 433 designates the liquid circulating inside the collection container whereas numeral reference 446 designates the surface current directed by the guide means 444 towards the inlet opening 454 of the inner circulation chamber and 435 designates the liquid flow which from the central circulation chamber at the bottom passes along the collection container bottom 413 and exits through the inlet opening. Numeral reference 456 and 457 designate a conduit through which substances collected inside the central circulation chamber by means of a pump 458 may be transported to a collection bag 459 or other receptacle which in accordance with the embodiment illustrated is connected to an adaptor 460 or similar means on the external face of the collection container. The connection device 460 or the bag 459 preferably could be configured in the manner of so called "portabulk" oil/water separators for temporary storage and transportation of collected oil. The inner circulation chamber 453 advantageously may be used also in connection with the other embodiments described in the aforegoing. The central circulation chamber could also be used separately in water flowing alongside an oil boom and in this case it serves a similar function to that of the outer circulation chamber in accordance with the last mentioned embodiment as well as earlier described embodiments.

The invention is not limited to the examples described in the aforegoing and illustrated in the drawings but could be varied as to its detail components within the scope of the appended claims without departing from the fundamental inventive idea of the invention. As is readily understood by the experts numeral combinations of the various details in components included in the various embodiments are possible. For instance, the various guide means inside the circulation chamber are applicable to all embodiments as are the devices for regulating the inlet opening size, which could be used also in connection with embodiments for which devices of this kind have not been described. All circulation chambers except those that are integrated with the vessel interior may be used on a vessel flank as well as on a bank of a watercourse. The invention has been described primarily in connection with removal of oil floating on water but the device might likewise be used for removal of other substances, such as chemical substances or objects floating on water. All combinations of the various details of the embodiment are possible within the scope of the invention, provided that the inflow water generates a circulating motion inside the collection container.

I claim:

1. An arrangement for separating and collecting a substance floating in water comprising:

a vessel moving in a forward direction relative to the water, which has a surface level;

a circulation chamber that has a side opening, an inner wall, a substantially closed bottom and a central vortex region, the side opening extending vertically substantially from the closed bottom to above the surface level of the water;

a collecting wall member that has an inboard end and an outboard end, that, at the inboard end, is attached to the circulation chamber, and that, in a deployed position, extends outward from the vessel, the outboard end lying forward of the inboard end and lying farther from the vessel than the inboard end;

separation means for separating and removing the floating substance from the water in the vortex region of the circulation chamber;

the collecting wall member extending vertically under the water to a lowermost level, which lies at a depth above the bottom of the circulation chamber, a lower portion of the side opening thereby extending below the lowermost level of the collecting wall member and an upper portion of the side opening thereby extending upward from the lowermost level of the collecting wall member;

the collecting wall member guiding water and the floating substance into the circulation chamber through the upper portion of the side opening and directing the water along the inner wall, the water thereby moving substantially in a rotating motion within the circulation chamber and the floating substance thereby collecting in the vortex region;

separated water exiting the circulation chamber substantially horizontally over the bottom of the circulation chamber and out through the lower portion of the side opening;

the side opening thereby forming both an inlet and an outlet opening of the circulation chamber at the upper and lower portions, respectively, of the side opening, uncollected water flowing outside of and past the circulation chamber and below the collecting wall member thereby increasing ejection of separated water from the circulation chamber.

2. An arrangement as in claim 1, in which the collecting wall member is substantially non-rigid and extends substantially vertically both above and below the water and, in a stored position, is contained within a space defined by the vessel and the circulation chamber.

3. An arrangement as in claim 2, in which the collecting wall member is housed within the circulation chamber in the stored position.

4. An arrangement as in claim 2, further including:

an outrigger arm with an inner end and an outer end, the inner end being secured to the vessel; and a hauling line that is attached at a first end to the outrigger arm's outer end and, at a second end, is attached to the outboard end of the collecting wall member; the outrigger arm and hauling line thereby forming deployment means for deploying the collecting wall member from the stored position to the deployed position.

5. An arrangement as in claim 1, in which the separation means includes:

a substantially cylindrical chamber with a lateral opening; and a curved guide member that extends from an edge of the lateral opening to the inner wall of the circulation chamber, guiding the water into the cylindrical chamber;

the cylindrical chamber thereby forming a secondary circulation chamber for the water and the floating substance.

6. An arrangement as in claim 5, in which the cylindrical chamber is vertically adjustable within the circulation chamber.

7. An arrangement as in claim 1, in which the circulation chamber includes an arcuately curved guide member that extends from the inner wall of the circulation chamber above and below the water toward the vortex region, further guiding the floating substance toward the vortex region.

8. An arrangement as in claim 1, in which the circulation chamber is a self-supporting, anchored float.

9. An arrangement as in claim 1, in which the circulation chamber is housed within a hull of the vessel, and in which the inlet opening is an opening in the hull.

10. A method for separating and collecting a substance floating in water comprising the following steps:

moving a vessel in a forward direction relative to the water;

deploying a collecting wall member to extend at an angle outward from the vessel and guiding the water and the floating substance through an upper, inlet portion of a side opening of an outboard vortical circulation chamber and along an inner wall of the circulation chamber, the water thereby moving substantially in a rotating motion within the circulation chamber, the floating substance thereby collecting in a vortex region within the circulation chamber; and removing the floating substance within the vortex region;

towing the collecting wall member and the circulation chamber through the water so that at least some unprocessed water at a level beneath a lowermost point of the collecting wall member flows past a side opening of the circulation chamber, water exiting the circulation chamber substantially horizontally through a lower outlet portion of the side opening thereby increasing ejection of separated water from the circulation chamber.

11. A method as in claim 10, further including the step of storing the collecting wall member within a space defined by the vessel and the circulation chamber when the collecting wall member is in a non-operational, stored position.

12. A method as in claim 10, in which the step of deploying the collecting wall member further includes the step of extending an outrigger arm from the vessel and hauling an outboard end of the collecting wall member outward to an outer end of the arm, an inboard end of the collecting wall member remaining attached near the inlet opening of the circulation chamber.

13. A method as in claim 10, further including the steps of locating the circulation chamber within a hull of the vessel, and forming the inlet opening as an opening in the vessel hull.

14. An arrangement for separating and collecting a substance floating in water comprising:

a vessel moving in a forward direction relative to the water, which has a surface level;

a circulation chamber that has a side opening, an inner wall, a substantially closed bottom and a central vortex region, the side opening extending vertically substantially from the closed bottom to above the surface level of the water;

a non-rigid, collecting wall member that has an inboard end and an outboard end, that, at the inboard end, is attached to the circulation chamber, that, in a deployed position, extends outward from the vessel, the outboard end lying forward of the inboard end and lying farther from the vessel than the inboard end;

and that, in a stored position, is contained within the space defined by the vessel and the circulation chamber;

an outrigger arm with an inner end and an outer end, the inner end being attached to the vessel;

a hauling line that is attached, at a first end, to the outrigger arm's outer end and, at a second end, is attached to the outboard end of the collecting wall member;

the outrigger arm and hauling line thereby forming deployment means for deploying the collecting wall member from the stored position to the deployed position;

separation means for separating and removing the floating substance from the water in the vortex region of the circulation chamber;

the collecting wall member extending vertically under the water to a lowermost level, which lies at a depth above the bottom of the circulation chamber, a lower portion of the side opening thereby extending below the lowermost level of the collecting wall member and an upper portion of the side opening thereby extending upward from the lowermost level of the collecting wall member;

the collecting wall member guiding water and the floating substance into the circulation chamber through the upper portion of the side opening and directing the water along the inner wall, the water thereby moving substantially in a rotating motion within the circulation chamber and the floating substance thereby collecting in the vortex region;

separated water exiting the circulation chamber substantially horizontally over the bottom of the circulation chamber and out through the lower portion of the side opening;

the side opening thereby forming both an inlet and an outlet opening of the circulation chamber at the upper and lower portions, respectively, of the side opening, uncollected water flowing outside of and past the circulation chamber and below the collecting wall member thereby increasing ejection of separated water from the circulation chamber.

* * * * *